US011008632B2

(12) United States Patent
Minami et al.

(10) Patent No.: US 11,008,632 B2
(45) Date of Patent: *May 18, 2021

(54) STEEL SHEET, COATED STEEL SHEET, METHOD FOR PRODUCING HOT-ROLLED STEEL SHEET, METHOD FOR PRODUCING COLD-ROLLED FULL HARD STEEL SHEET, METHOD FOR PRODUCING HEAT-TREATED SHEET, METHOD FOR PRODUCING STEEL SHEET, AND METHOD FOR PRODUCING COATED STEEL SHEET

(71) Applicant: JFE Steel Corporation, Tokyo (JP)

(72) Inventors: Hidekazu Minami, Tokyo (JP); Yoshimasa Funakawa, Tokyo (JP); Shinjiro Kaneko, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 204 days.

This patent is subject to a terminal disclaimer.

(21) Appl. No.: 16/086,431

(22) PCT Filed: Mar. 7, 2017

(86) PCT No.: PCT/JP2017/008957

§ 371 (c)(1),
(2) Date: Sep. 19, 2018

(87) PCT Pub. No.: WO2017/169561

PCT Pub. Date: Oct. 5, 2017

(65) Prior Publication Data

US 2019/0100819 A1 Apr. 4, 2019

(30) Foreign Application Priority Data

Mar. 31, 2016 (JP) ..... JP2016-070749
Nov. 30, 2016 (JP) ..... JP2016-232543

(51) Int. Cl.

| | |
|---|---|
| ***C21D 8/02*** | (2006.01) |
| ***C22C 38/02*** | (2006.01) |
| ***C23C 2/02*** | (2006.01) |
| ***C23C 2/06*** | (2006.01) |
| ***C21D 9/46*** | (2006.01) |
| ***C22C 38/06*** | (2006.01) |
| ***C22C 38/00*** | (2006.01) |
| ***C23C 2/28*** | (2006.01) |
| ***C22C 38/04*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/38*** | (2006.01) |

(52) U.S. Cl.

CPC ..... *C21D 8/0263* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/38* (2013.01); *C23C 2/02* (2013.01); *C23C 2/06* (2013.01); *C23C 2/28* (2013.01); *C21D 8/0226* (2013.01); *C21D 8/0236* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 2007/0144633 | A1 | 6/2007 | Kizu et al. | |
| 2011/0209800 | A1* | 9/2011 | Kim | C21D 8/0405 148/533 |
| 2012/0037281 | A1* | 2/2012 | Ono | C22C 38/002 148/533 |
| 2012/0090737 | A1 | 4/2012 | Fushiwaki et al. | |
| 2014/0193667 | A1 | 7/2014 | Shuto et al. | |

(Continued)

FOREIGN PATENT DOCUMENTS

| | | | |
|---|---|---|---|
| JP | 1192859 | A | 4/1999 |
| JP | 2000212684 | A | 8/2000 |

(Continued)

OTHER PUBLICATIONS

International Search Report and Written Opinion for International Application No. PCT/JP2017/008957, dated Jun. 13, 2017—8 pages.
Japanese Office Action for Japanese Application No. 2017-146617, dated Sep. 11, 2018 with Concise Statement of Relevance of Office Action, 5 pages.
Non Final Office Action for U.S. Appl. No. 16/086,044, dated Nov. 10, 2020, 16 pages.

*Primary Examiner* — Anthony J Zimmer
*Assistant Examiner* — Dean Mazzola
(74) *Attorney, Agent, or Firm* — RatnerPrestia

(57) ABSTRACT

A steel sheet is provided that has a tensile strength of 540 MPa or more, includes a particular composition; and has a steel structure containing ferrite and a secondary phase, in which an area fraction of the ferrite is 50% or more, the secondary phase contains 1.0% or more and 25.0% or less of martensite in terms of area fraction with respect to the entirety, the ferrite has an average crystal grain size of 3 μm or more, a difference in hardness between the ferrite and the martensite is 1.0 GPa or more and 8.0 GPa or less, and, in a texture of the ferrite, an inverse intensity ratio of γ-fiber to α-fiber is 0.8 or more and 7.0 or less.

32 Claims, No Drawings

(56) References Cited

U.S. PATENT DOCUMENTS

| | | | | |
|---|---|---|---|---|
| 2015/0017472 | A1* | 1/2015 | Kimura et al. | C21D 8/0273<br>428/659 |
| 2016/0186283 | A1 | 6/2016 | Minami et al. | |
| 2016/0186299 | A1 | 6/2016 | Minami et al. | |
| 2017/0152580 | A1 | 6/2017 | Kimura et al. | |

FOREIGN PATENT DOCUMENTS

| | | | | |
|---|---|---|---|---|
| JP | 2002241897 | A | 8/2002 | |
| JP | 2007182625 | A | 7/2007 | |
| JP | 2010013700 | A | 1/2010 | |
| JP | 2010126747 | A | 6/2010 | |
| JP | 2010255100 | A | 11/2010 | |
| JP | 2013177673 | A | 9/2013 | |
| JP | 5884210 | B1 | 3/2016 | |
| WO | 2013015428 | A1 | 1/2013 | |
| WO | WO-2013114850 | A1 * | 8/2013 | B32B 15/013 |
| WO | 2015015738 | A1 | 2/2015 | |
| WO | 2015015739 | A1 | 2/2015 | |

* cited by examiner

STEEL SHEET, COATED STEEL SHEET, METHOD FOR PRODUCING HOT-ROLLED STEEL SHEET, METHOD FOR PRODUCING COLD-ROLLED FULL HARD STEEL SHEET, METHOD FOR PRODUCING HEAT-TREATED SHEET, METHOD FOR PRODUCING STEEL SHEET, AND METHOD FOR PRODUCING COATED STEEL SHEET

CROSS REFERENCE TO RELATED APPLICATIONS

This is the U.S. National Phase application of PCT/JP2017/008957, filed Mar. 7, 2017, which claims priority to Japanese Patent Application No. 2016-070749, filed Mar. 31, 2016 and Japanese Patent Application No. 2016-232543, filed Nov. 30, 2016, the disclosures of each of these applications being incorporated herein by reference in their entireties for all purposes.

FIELD OF THE INVENTION

The present invention relates to a steel sheet, a coated steel sheet, a method for producing a hot-rolled steel sheet, a method for producing a cold-rolled full hard steel sheet, a method for producing a heat-treated sheet, a method for producing a steel sheet, and a method for producing a coated steel sheet. The steel sheets etc., of the present invention are suitable for use in structural elements, such as automobile parts.

BACKGROUND OF THE INVENTION

The rise in consciousness of global environmental protection in recent years has strongly urged improvements be made in fuel efficiency to reduce the $CO_2$ emission from automobiles. Under such trends, there has been increasing activity towards increasing the strength of the automobile body material to achieve thickness reduction and weight reduction of automobile bodies. However, increasing the strength of steel sheets poses a risk of degrading ductility. Thus, development of high-strength, high-ductility steel sheets is anticipated. Moreover, increasing the strength of and decreasing the thickness of steel sheets significantly degrade shape fixability. To address this issue, it has been a widespread practice to forecast in advance the change in shape after demolding and to design the mold at the time of press-forming by taking into account the amount of change in shape. However, once the yield stress (YP) of a steel sheet changes, there occurs a large deviation from the amount anticipated from the presumption that the yield stress is constant, shape defects are generated, and correction, such as sheet-metal-working of shapes of individual pieces after press-forming becomes necessary, thereby significantly degrading the mass production efficiency. Thus, variation in YP of steel sheets needs to be minimized.

To improve the ductility of high-strength cold-rolled steel sheets and high-strength galvanized steel sheets, there have been developed a variety of multi-phase high-strength steel sheets, such as ferrite-martensite dual phase steel (dual-phase steel) and TRIP steel that utilizes the transformation-induced plasticity of retained austenite.

For example, regarding the high-strength cold-rolled steel sheets and the high-strength galvanized steel sheets, Patent Literature 1 discloses a steel sheet having excellent ductility, in which the composition and the volume fractions of the ferrite, bainitic ferrite, and retained austenite are specified.

Patent Literature 2 discloses a method for producing a high-strength cold-rolled steel sheet in which variation in elongation in the sheet width direction is addressed.

PATENT LITERATURE

PTL 1: Japanese Unexamined Patent Application Publication No. 2007-182625

PTL 2: Japanese Unexamined Patent Application Publication No. 2000-212684

SUMMARY OF THE INVENTION

Although the high-strength steel sheets are described in Patent Literatures 1 and 2 as having particularly excellent ductility among various properties related to workability, planar anisotropy of YP is not considered.

The present invention has been developed under the above-described circumstances, and an object thereof is to provide a steel sheet that has a TS of 540 MPa or more, excellent ductility, a low yield ratio (YR), excellent YP planar anisotropy, and excellent coatability, a coated steel sheet, and methods for producing the steel sheet and the coated steel sheet. Another object is to provide a method for producing a hot-rolled steel sheet, a method for producing a cold-rolled full hard steel sheet, and a method for producing a heat-treated sheet needed to obtain the aforementioned steel sheet and the coated steel sheet.

For the purposes of the present invention, excellent ductility or El (total elongation) means that the product, TS×El, is 15000 MPa·% or more. Moreover, a low YR means that the value, YR=(YP/TS)×100, is 75% or less. Moreover, excellent YP planar anisotropy means that the value of the index of the planar anisotropy of YP, |ΔYP|, is 50 MPa or less. Here, |ΔYP| is determined by formula (1) below:

$$|\Delta YP| = (YPL - 2 \times YPD + YPC)/2 \quad (1)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

The inventors of the present invention have conducted extensive studies to obtain a steel sheet that has a TS of 540 MPa or more, excellent ductility, low YR, excellent YP planar anisotropy, and excellent coatability when subjected to coating, and found the following.

The inventors have found that the ductility can be improved, the YR can be decreased, and the YP planar anisotropy can be reduced simultaneously and the coatability when subjected to coating can be enhanced by promoting recrystallization of ferrite during heating during annealing and by appropriately adjusting the area fraction and the like of martensite, which is one of the secondary phases (meaning phases other than ferrite, e.g., martensite, un-recrystallized ferrite, tempered martensite, bainite, tempered bainite, pearlite, cementite (including alloy carbides), retained austenite, etc.).

As a result, it has become possible to obtain a steel sheet or the like that has a TS of 540 MPa or more, excellent ductility, a low yield ratio (YR), excellent YP planar anisotropy, and excellent coatability when subjected to coating.

The present invention has been made on the basis of the above-described findings. In other words, the summary of the features according to exemplary embodiments of the present invention is as follows.

[1] A steel sheet having: a composition that contains, in terms of mass %, C: 0.03% or more and 0.20% or less, Si: 0.70% or less, Mn: 1.50% or more and 3.00% or less, P: 0.001% or more and 0.100% or less, S: 0.0001% or more and 0.0200% or less, Al: 0.001% or more and 1.000% or less, N: 0.0005% or more and 0.0100% or less, and the balance being Fe and unavoidable impurities; a steel structure containing ferrite and a secondary phase, in which an area fraction of the ferrite is 50% or more, the secondary phase contains 1.0% or more and 25.0% or less of martensite in terms of area fraction with respect to the entirety, the ferrite has an average crystal grain size of 3 μm or more, a difference in hardness between the ferrite and the martensite is 1.0 GPa or more and 8.0 GPa or less, and, in a texture of the ferrite, an inverse intensity ratio of γ-fiber to α-fiber is 0.8 or more and 7.0 or less; and, a tensile strength of 540 MPa or more.

[2] The steel sheet described in [1], in which the martensite has an average size of 1.0 μm or more and 15.0 μm or less.

[3] The steel sheet described in [1] or [2], wherein the composition further contains, in terms of mass %, at least one element selected from Mo: 0.01% or more and 0.50% or less, Ti: 0.001% or more and 0.100% or less, Nb: 0.001% or more and 0.100% or less, V: 0.001% or more and 0.100% or less, B: 0.0001% or more and 0.0050% or less, Cr: 0.01% or more and 1.00% or less, Cu: 0.01% or more and 1.00% or less, Ni: 0.01% or more and 1.00% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

[4] A coated steel sheet including the steel sheet described in any one of [1] to [3], and a coating layer on a surface of the steel sheet.

[5] A method for producing a hot-rolled steel sheet, the method including heating a steel slab having the composition described in [1] or [3]; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower.

[6] A method for producing a cold-rolled full hard steel sheet, the method including pickling a hot-rolled steel sheet obtained in the method described in [5], and cold-rolling the pickled steel sheet at a rolling reduction of 35% or more.

[7] A method for producing a steel sheet, the method including heating a hot-rolled steel sheet obtained in the method described in [5] or a cold-rolled full hard steel sheet obtained in the method described in [6] under conditions of a maximum attained temperature of a T1 temperature or higher and a T2 temperature or lower and a residence time of 500 s or less in a temperature range of [maximum attained temperature—50° C.] to the maximum attained temperature; and cooling the heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1\ \text{temperature}\ (^\circ\ \text{C.})=745+29\times[\%\ \text{Si}]-21\times[\%\ \text{Mn}]+17\times[\%\ \text{Cr}]$$

$$T2\ \text{temperature}\ (^\circ\ \text{C.})=960-203\times[\%\ \text{C}]^{1/2}+45\times[\%\ \text{Si}]-30\times[\%\ \text{Mn}]+150\times[\%\ \text{Al}]-20\times[\%\ \text{Cu}]+11\times[\%\ \text{Cr}]+350\times[\%\ \text{Ti}]+104\times[\%\ \text{V}]$$

where in the formulae above, [% X] denotes a content (mass %) of a component element X in the steel sheet.

[8] A method for producing a heat-treated sheet, the method including heating a hot-rolled steel sheet obtained in the method described in [5] or a cold-rolled full hard steel sheet obtained in the method described in [6] under conditions of a maximum attained temperature of a T1 temperature or higher and a T2 temperature or lower and a residence time of 500 s or less in a temperature range of [maximum attained temperature—50° C.] to the maximum attained temperature; and then cooling the heated sheet and pickling the cooled sheet, where:

$$T1\ \text{temperature}\ (^\circ\ \text{C.})=745+29\times[\%\ \text{Si}]-21\times[\%\ \text{Mn}]+17\times[\%\ \text{Cr}]$$

$$T2\ \text{temperature}\ (^\circ\ \text{C.})=960-203\times[\%\ \text{C}]^{1/2}+45\times[\%\ \text{Si}]-30\times[\%\ \text{Mn}]+150\times[\%\ \text{Al}]-20\times[\%\ \text{Cu}]+11\times[\%\ \text{Cr}]+350\times[\%\ \text{Ti}]+104\times[\%\ \text{V}]$$

where in the formulae above, [% X] denotes a content (mass %) of a component element X in the steel sheet.

[9] A method for producing a steel sheet, the method including re-heating a heat-treated sheet obtained in the method described in [8] to a temperature equal to or higher than the T1 temperature; and then cooling the re-heated sheet under a condition of an average cooling rate of 3° C./s or more in a temperature range of [T1 temperature—10° C.] to 550° C., wherein a dew point in a temperature range of 600° C. or higher is −40° C. or lower.

[10] A method for producing a coated steel sheet, the method including coating a steel sheet obtained by the method described in [7] or [9].

A steel sheet and a coated steel sheet obtained by an embodiment of the present invention have a TS of 540 MPa or more, excellent ductility, a low yield ratio (YR), excellent YP planar anisotropy, and excellent coatability when subjected to coating. Moreover, when the steel sheet and the coated steel sheet obtained in the present invention are applied to, for example, automobile structural elements, fuel efficiency can be improved through car body weight reduction, and thus embodiments of the present invention offers considerable industrial advantages. TS is preferably 590 MPa or more.

Furthermore, the method for producing a hot-rolled steel sheet, the method for producing a cold-rolled full hard steel sheet, and the method for producing a heat-treated sheet according to embodiments of the present invention serve as the methods for producing intermediate products for obtaining the steel sheet and the coated steel sheet with excellent properties described above and contribute to improving the properties of the steel sheet and the coated steel sheet described above.

DETAILED DESCRIPTION OF EMBODIMENTS OF THE INVENTION

The embodiments of the present invention will now be described. It should be understood that the present invention is not limited to the following embodiment.

The present invention provides a steel sheet, a coated steel sheet, a method for producing a hot-rolled steel sheet, a method for producing a cold-rolled full hard steel sheet, a method for producing a heat-treated sheet, a method for producing a steel sheet, and a method for producing a coated steel sheet. First, how these relate to one another is described.

A steel sheet of the present invention also serves as an intermediate product for obtaining a coated steel sheet of the present invention. In a one-stage method, a steel such as a slab is used as a starting material, and a coated steel sheet is obtained through the process of producing a hot-rolled steel sheet, a cold-rolled full hard steel sheet, and a steel sheet (however, when cold-rolling is not performed, the process of producing the cold-rolled full hard steel sheet is skipped). In a two-stage method, a steel such as a slab is used as a starting material, and a coated steel sheet is obtained through the process of producing a hot-rolled steel sheet, a cold-rolled full hard steel sheet, a heat-treated sheet, and a steel sheet (however, when cold-rolling is not performed, the process of producing the cold-rolled full hard steel sheet is skipped). The steel sheet of the present invention is the steel sheet used in the above-described process. The steel sheet may be a final product in some cases.

The method for producing a hot-rolled steel sheet of the present invention is the method that covers up to obtaining a hot-rolled steel sheet in the process described above.

The method for producing a cold-rolled full hard steel sheet of the present invention is the method that covers up to obtaining a cold-rolled full hard steel sheet from a hot-rolled steel sheet in the process described above.

The method for producing a heat-treated sheet of the present invention is the method that covers up to obtaining a heat-treated sheet from a hot-rolled steel sheet or a cold-rolled full hard steel sheet in the process described above in the two-stage method.

The method for producing a steel sheet of the present invention is the method that covers up to obtaining a steel sheet from a hot-rolled steel sheet or a cold-rolled full hard steel sheet in the process described above in the case of one-stage method, or is the method that covers up to obtaining a steel sheet from a heat-treated sheet in the case of two-stage method.

The method for producing a coated steel sheet of the present invention is the method that covers up to obtaining a coated steel sheet from a steel sheet in the process described above.

Since such a relationship exists, the compositions of the hot-rolled steel sheet, the cold-rolled full hard steel sheet, the heat-treated sheet, the steel sheet, and the coated steel sheet are common, and the steel structures of the steel sheet and the coated steel sheet are common. In the description below, the common features, the steel sheet, the coated steel sheet, and the production methods therefor are described in that order.

Composition

A steel sheet or the like according to embodiments of the present invention has a composition containing, in terms of mass %, C: 0.03% or more and 0.20% or less, Si: 0.70% or less, Mn: 1.50% or more and 3.00% or less, P: 0.001% or more and 0.100% or less, S: 0.0001% or more and 0.0200% or less, Al: 0.001% or more and 1.000% or less, N: 0.0005% or more and 0.0100% or less, and the balance being Fe and unavoidable impurities.

The composition may further contain, in terms of mass %, at least one element selected from Mo: 0.01% or more and 0.50% or less, Ti: 0.001% or more and 0.100% or less, Nb: 0.001% or more and 0.100% or less, V: 0.001% or more and 0.100% or less, B: 0.0001% or more and 0.0050% or less, Cr: 0.01% or more and 1.00% or less, Cu: 0.01% or more and 1.00% or less, Ni: 0.01% or more and 1.00% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less.

The individual components will now be described. In the description below, "%" that indicates the content of the component means "mass %".

C: 0.03% or More and 0.20% or Less

Carbon (C) is one of the important basic components of steel and is particularly important for embodiments of the present invention since carbon affects the austenite area fraction when heated to a dual-phase region and also affects the martensite area fraction after transformation. The mechanical properties, such as strength, of the obtained steel sheet depend significantly on the fraction (area fraction), the hardness, and the average size of the martensite. Here, if the C content is less than 0.03%, the desired martensite fraction cannot be obtained, and it is difficult to obtain strength of the steel sheet. Meanwhile, at a C content exceeding 0.20%, the hardness of the martensite increases, and the difference in hardness between ferrite and martensite increases. Thus, the local elongation is degraded, and the total elongation is degraded as a result. Moreover, since the average size of martensite increases, the local elongation is degraded, and the total elongation is degraded. Thus, the C content is set within a range of 0.03% or more and 0.20% or less. The lower limit of the C content is preferably 0.04% or more. The upper limit of the C content is preferably 0.15% or less and more preferably 0.12% or less.

Si: 0.70% or Less

Silicon (Si) is an element that improves workability, such as elongation, by decreasing the dissolved C content in the $\alpha$ phase. However, at a Si content exceeding 0.70%, an effect of accelerating ferrite transformation during cooling in an annealing process and an effect of suppressing carbide generation are exhibited, the hardness of martensite increases, and the difference in hardness between ferrite and martensite increases, thereby degrading the local elongation and the total elongation. Moreover, deterioration of surface properties due to occurrence of red scale etc., and, if galvanizing is to be performed, deteriorations of the coating-adhering property and adhesion will result. Thus, the Si content is set to be 0.70% or less, preferably 0.60% or less, and more preferably 0.50% or less.

Moreover, when galvanizing is to be performed, as long as the Si content is 0.40% or less, the increase in the amount of Si concentrated in the surface during annealing is further suppressed, and degradation of the wettability of the annealed sheet surface is further suppressed. Thus, the coating-adhering property and the adhesion are enhanced.

Thus, the Si content is set to be 0.40% or less and preferably 0.35% or less. In the present invention, the Si content is usually 0.01% or more.

Mn: 1.50% or More and 3.00% or Less

Manganese (Mn) is effective for securing the strength of the steel sheet. Manganese also improves hardenability and facilitates formation of a multi-phase structure. At the same time, Mn has an effect of suppressing generation of pearlite and bainite during the cooling process, and has a tendency to facilitate austenite-to-martensite transformation. In order to obtain these effects, the Mn content needs to be 1.50% or more. Meanwhile at a Mn content exceeding 3.00%, the average size of martensite increases, the local elongation is degraded, and the total elongation is degraded. Moreover, the spot weldability and the coatability are impaired. In addition, castability or the like is degraded. Furthermore, Mn segregation in the sheet thickness direction becomes prominent, the YR increases as a result, and the value, TS×El, decreases. Thus, the Mn content is set to be 1.50% or more and 3.00% or less. The lower limit of the Mn content is preferably 1.60% or more. The upper limit of the Mn content is preferably 2.70% or less and more preferably 2.40% or less.

P: 0.001% or More and 0.100% or Less

Phosphorus (P) is an element that has an effect of solid solution strengthening and can be added according to the desired strength. Moreover, P is also an element that accelerates ferrite transformation and is effective for formation of a multi-phase structure. In order to obtain these effects, the P content needs to be 0.001% or more. Meanwhile, at a P content exceeding 0.100%, P segregates in the ferrite grain boundaries or heterophase interfaces between ferrite and martensite and makes the grain boundaries brittle, thereby degrading local elongation and total elongation. Moreover, weldability is deteriorated, and, when galvannealing is to be performed, the speed of alloying is significantly decreased, and the quality of the coating is impaired. At a P content exceeding 0.100%, grain boundary segregation causes embrittlement, and thus the impact resistance is degraded. Thus, the P content is set to be 0.001% or more and 0.100% or less. The lower limit of the P content is preferably 0.005% or more. The upper limit of the P content is preferably 0.050% or less.

S: 0.0001% or More and 0.0200% or Less

Sulfur (S) segregates in grain boundaries, embrittles the steel during hot-working, and forms sulfides that degrade local deformability and ductility. Thus, the S content needs to be 0.0200% or less. Meanwhile, from the limitation posed by the manufacturing technology, the S content needs to be 0.0001% or more. Thus, the S content is set to be 0.0001% or more and 0.0200% or less. The lower limit of the S content is preferably 0.0001% or more. The upper limit of the S content is preferably 0.0050% or less.

Al: 0.001% or More and 1.000% or Less

Aluminum (Al) is an element that suppresses generation of carbides and is effective for accelerating generation of martensite. Moreover, Al is an element that is added as deoxidant in the steel-making process. In order to obtain these effects, the Al content needs to be 0.001% or more. Meanwhile, an Al content exceeding 1.000% increases the amount of inclusions in the steel sheet and degrades ductility. Thus, the Al content is set to be 0.001% or more and 1.000% or less. The lower limit of the Al content is preferably 0.030% or more. The upper limit of the Al content is preferably 0.500% or less.

N: 0.0005% or More and 0.0100% or Less

Nitrogen (N) bonds with Al and forms AlN. When B is added, N forms BN. When the N content is large, a large amount of nitrides occur and obstruct grain growth of ferrite grains, the ferrite grains become fine as a result, and the workability is deteriorated. Thus, in an embodiment of the present invention, the N content is set to be 0.0100% or less. However, from the limitation posed by the manufacturing technology, the N content needs to be 0.0005% or more. Thus, the N content is set to be 0.0005% or more and 0.0100% or less. The N content is preferably 0.0005% or more and 0.0070% or less.

The steel sheet of the present invention preferably further contains, in addition to the components described above, in terms of mass %, at least one optional element selected from Mo: 0.01% or more and 0.50% or less, Ti: 0.001% or more and 0.100% or less, Nb: 0.001% or more and 0.100% or less, V: 0.001% or more and 0.100% or less, B: 0.0001% or more and 0.0050% or less, Cr: 0.01% or more and 1.00% or less, Cu: 0.01% or more and 1.00% or less, Ni: 0.01% or more and 1.00% or less, As: 0.001% or more and 0.500% or less, Sb: 0.001% or more and 0.200% or less, Sn: 0.001% or more and 0.200% or less, Ta: 0.001% or more and 0.100% or less, Ca: 0.0001% or more and 0.0200% or less, Mg: 0.0001% or more and 0.0200% or less, Zn: 0.001% or more and 0.020% or less, Co: 0.001% or more and 0.020% or less, Zr: 0.001% or more and 0.020% or less, and REM: 0.0001% or more and 0.0200% or less. These optional elements may be contained alone or in combination. The balance of the composition of the steel sheet is Fe and unavoidable impurities.

Molybdenum (Mo) is effective for obtaining martensite without degrading chemical conversion treatability and coatability, and thus may be added as needed. This effect is obtained by setting the Mo content to 0.01% or more. However, at a Mo content exceeding 0.50%, enhancement of the effect is rarely achieved, the amount of inclusions and the like increases, the defects and the like are thereby formed in the surface or in the inside, and the ductility is significantly degraded. Thus, the Mo content is set within a range of 0.01% or more and 0.50% or less. The lower limit of the Mo content is preferably 0.02% or more. The upper limit of the Mo content is preferably 0.35% or less and more preferably 0.25% or less.

Titanium (Ti) is an element effective for fixing N, which induces aging degradation, by forming TiN, and thus may be added as needed. This effect is obtained by setting the Ti content to 0.001% or more. Meanwhile, at a Ti content exceeding 0.100%, TiC occurs excessively, and the yield ratio YR increases notably. Thus, if Ti is to be added, the Ti content is set within a range of 0.001% or more and 0.100% or less, and the lower limit is preferably 0.005% or more. The upper limit is preferably 0.050% or less.

Niobium (Nb) forms fine precipitates during hot-rolling or annealing, and increases the strength, and thus may be added as needed. Niobium also reduces the size of grains during hot-rolling, and accelerates recrystallization of ferrite, which contributes to decreasing the YP planar anisotropy, during cold-rolling and the subsequent annealing. In order to obtain these effects, the Nb content needs to be 0.001% or more.

Meanwhile, at a Nb content exceeding 0.100%, composite precipitates, such as Nb—(C, N), occur excessively, the size of ferrite grains is reduced, and the yield ratio YR increases notably. Thus, if Nb is to be added, the Nb content is set within a range of 0.001% or more and 0.100% or less. The lower limit of the Nb content is preferably 0.005% or more. The upper limit of the Nb content is preferably 0.050% or less.

Vanadium (V) increases the strength of steel by forming carbides, nitrides, or carbonitrides, and thus may be added as needed. In order to obtain this effect, the V content needs to be 0.001% or more. Meanwhile, at a V content exceeding 0.100%, V precipitates and forms large quantities of carbides, nitrides, or carbonitrides in former austenite grain boundaries, a substructure of martensite, or ferrite serving as a base phase, and significantly degrades workability. Thus, if V is to be added, the V content is set within a range of 0.001% or more and 0.100% or less. The lower limit of the V content is preferably 0.005% or more and more preferably 0.010% or more. The upper limit of the V content is preferably 0.080% or less and more preferably 0.070% or less.

Boron (B) is an element effective for strengthening the steel, and thus may be added as needed. The effect of adding B is obtained by setting the B content to 0.0001% or more. Meanwhile, at a B content exceeding 0.0050%, the martensite area fraction becomes excessively large, and there occurs a risk of degradation of ductility due to the excessive increase in strength. Thus, the B content is set to be 0.0001% or more and 0.0050% or less. The lower limit of the B content is preferably 0.0005% or, more. The upper limit of the B content is preferably 0.0030% or less.

Chromium (Cr) and copper (Cu) not only have a role of solid solution strengthening element but also stabilize austenite during the cooling process in annealing (process of heating and then cooling a cold-rolled steel sheet or a hot-rolled steel sheet (if cold-rolling is not performed)) and facilitate formation of the multi-phase structure. Thus, Cr and Cu may be added as needed. In order to obtain these effects, the Cr content and the Cu content need to be 0.01% or more each. However, at a Cr or Cu content exceeding 1.00%, the surface layer may crack during hot-rolling, the amount of inclusions and the like increases, defects and the like are thereby formed in the surface or in the inside, and the ductility is significantly degraded. Thus, if Cr and Cu are to be added, the content of each element is set within a range of 0.01% or more and 1.00% or less.

Nickel (Ni) contributes to increasing the strength by solid solution strengthening and transformation strengthening, and may be added as needed. In order to obtain this effect, the Ni content needs to be 0.01% or more. However, at a Ni content exceeding 1.00%, the surface layer may crack during hot-rolling, the amount of inclusions and the like increases, the defects and the like are thereby formed in the surface or in the inside, and the ductility is significantly degraded. Thus, if Ni is to be added, the Ni content is set within a range of 0.01% or more and 1.00% or less. Preferably, the Ni content is 0.50% or less.

Arsenic (As) is an element effective for improving corrosion resistance, and may be added as needed. In order to obtain this effect, the As content needs to be 0.001% or more. However, if As is added excessively, red shortness is accelerated, the amount of inclusions and the like increases, the defects and the like are thereby formed in the surface or in the inside, and the ductility is significantly degraded. Thus, if As is to be added, the As content is set within a range of 0.001% or more and 0.500% or less.

Antimony (Sb) and tin (Sn) are added as needed from the viewpoint of suppressing decarburization that occurs due to nitriding or oxidizing of the steel sheet surface in a region that spans about several ten micrometers from the steel sheet surface in the sheet thickness direction. This is because, when nitriding or oxidizing is suppressed, the decrease in the amount of martensite generated in the steel sheet surface is prevented, and the strength and the material stability of the steel sheet can be effectively ensured. In order to obtain these effects, the content needs to be 0.001% or more for Sb and for Sn. Meanwhile, if any of these elements is added in an amount exceeding 0.200%, toughness is degraded. Thus, if Sb and Sn are to be added, the content is set within a range of 0.001% or more and 0.200% or less for each of the elements.

Tantalum (Ta) contributes to increasing the strength by forming alloy carbides and alloy carbonitrides as with Ti and Nb, and may be added as needed. In addition, Ta is considered to have an effect of partly dissolving in Nb carbides and/or Nb carbonitrides to form composite precipitates such as (Nb, Ta)(C, N) so as to significantly suppress coarsening of precipitates and stabilize the contribution to improving the strength of the steel sheet by precipitation strengthening. Thus, Ta is preferably contained. Here, the effect of stabilizing the precipitates described above is obtained by setting the Ta content to 0.001% or more; however, when Ta is excessively added, the precipitate stabilizing effect is saturated, the amount of inclusions and the like increases, the defects and the like are thereby formed in the surface or in the inside, and the ductility is significantly degraded. Thus, if Ta is to be added, the Ta content is set within a range of 0.001% or more and 0.100% or less.

Calcium (Ca) and magnesium (Mg) are elements used for deoxidization, and also are elements that are effective for making sulfides spherical and alleviating adverse effects of sulfides on ductility, in particular, local ductility, and may be added as needed. In order to obtain these effects, at least one of these elements needs to be contained in an amount of 0.0001% or more. However, if the amount of at least one element selected from Ca and Mg exceeds 0.0200%, the amount of inclusions and the like increases, the defects and the like are thereby formed in the surface or in the inside, and the ductility is significantly degraded. Thus, if Ca and Mg are to be added, the content is set within a range of 0.0001% or more and 0.0200% or less for each of the elements.

Zinc (Zn), cobalt (Co), and zirconium (Zr) are elements effective for making sulfides spherical and alleviating adverse effects of sulfides on local ductility and stretch flangeability, and may be added as needed. In order to obtain this effect, at least one of these elements needs to be contained in an amount of 0.001% or more. However, if the amount of at least one element selected from Zn, Co, and Zr exceeds 0.020%, the amount of inclusions and the like increases, the defects and the like are thereby formed in the surface or in the inside, and the ductility is thereby degraded. Thus, if Zn, Co, and Zr are to be added, the content is set within a range of 0.001% or more and 0.020% or less for each of the elements.

REM is an element effective for improving corrosion resistance, and may be added as needed. In order to obtain this effect, the REM content needs to be 0.0001% or more. However, if the REM content exceeds 0.0200%, the amount of inclusions and the like increases, the defects and the like are thereby formed in the surface or in the inside, and the ductility is thereby degraded. Thus, if REM is to be added, the REM content is set within a range of 0.0001% or more and 0.0200% or less.

The balance other than the above-described components is Fe and unavoidable impurities. For optional components described above, if their contents are less than the lower limits, the effects of the present invention are not impaired; thus, when these optional elements are contained in amounts less than the lower limits, these optional elements are deemed to be contained as unavoidable impurities.

Steel Structure

The steel structure of the steel sheet, etc., according to embodiments of the present invention contains ferrite and a secondary phase. The area fraction of the ferrite is 50% or more. The secondary phase contains 1.0% or more and 25.0% or less of martensite in terms of area fraction with respect to the entirety (the entirety of the steel structure). The ferrite has an average crystal grain size of 3 μm or more. The difference in hardness between the ferrite and the martensite is 1.0 GPa or more and 8.0 GPa or less, and, in a texture of the ferrite, the inverse intensity ratio of γ-fiber to α-fiber is 0.8 or more and 7.0 or less.

Ferrite Area Fraction: 50% or More

The ferrite area fraction relative to the entire steel structure is an extremely important invention-constituting element in embodiments of the present invention. The steel sheet and the like according to embodiments of the present invention each have a steel structure that contains ferrite, which has high ductility and is soft, and a secondary phase mainly responsible strength. In order to obtain sufficient ductility and strike a balance between strength and ductility, the ferrite area fraction needs to be 50% or more. The upper limit of the ferrite area fraction is not particularly limited; however, in order to obtain the area fraction of the secondary phase, i.e., to obtain strength, the upper limit is preferably 95% or less and more preferably 90% or less.

Here, the secondary phase refers to any phases other than ferrite, as described above, and may mean martensite, unrecrystallized ferrite, tempered martensite, bainite, tempered bainite, pearlite, cementite (including alloy carbides), retained austenite, or the like.

Martensite Area Fraction: 1.0% or More and 25.0% or Less

When the area fraction of martensite (meaning as-quenched martensite) relative to the entire steel structure exceeds 25.0%, local ductility is degraded, and thus the total elongation (El) is degraded. In order for the steel sheet to obtain the strength and decrease the YR, the area fraction of martensite needs to be 1.0% or more, preferably 3.0% or more, more preferably 5.0% or more, and yet more preferably 7.0% or more.

The area fractions of ferrite and martensite can be obtained as follows. After a sheet-thickness section (L section) parallel to the rolling direction of the steel sheet is polished, the section is corroded with a 1 vol. % nital, and three view areas at a position ¼ of the sheet thickness (the position at a depth of ¼ of the sheet thickness from the steel sheet surface) are observed by using a scanning electron microscope (SEM) at a magnification of ×1000. From the obtained structure images, the area fractions of the structural phases (ferrite and martensite) are calculated for three view areas by using Adobe Photoshop available from Adobe Systems, and the averages of the calculated results are assumed as the area fractions. Moreover, in the structure images described above, ferrite appears as a gray structure (matrix) and martensite appears as a white structure.

Average Crystal Grain Size of Ferrite: 3 μm or More

When the average crystal grain size of ferrite is less than 3 μm, ductility is degraded, and the YR is significantly increased. Thus, the average crystal grain size of ferrite is set to be 3 μm or more. The upper limit of the average crystal grain size of ferrite is not particularly limited. However, when the average crystal grain size exceeds 30 μm, formation of the secondary phase advantageous for increasing the strength is significantly suppressed. Thus, the average crystal grain size of ferrite is preferably 30 μm or less.

The average crystal grain size of ferrite is calculated as follows. That is, as in the observation of the phases described above, the observation position is set to the position of ¼ of the sheet thickness, the obtained steel sheet is observed with a scanning electron microscope (SEM) at a magnification of about ×1000, and, by using Adobe Photoshop described above, the total area of the ferrite grains within the observation view area is divided by the number of ferrite grains so as to calculate the average area of the ferrite grains. The calculated average area is raised to the power of ½, and the result is assumed to be the average crystal grain size of ferrite.

In the steel structure of the present invention, the total area fraction of ferrite and martensite is preferably 85% or more. The effects of the present invention are not impaired even when the steel structure contains, in addition to ferrite and martensite and in terms of area fraction relative to the entire steel structure, 20% or less of phases known to be included in steel sheets, such as un-recrystallized ferrite, tempered martensite, bainite, tempered bainite, pearlite, cementite (including alloy carbides), and retained austenite. However, from the viewpoint of yield ratio, the pearlite and the retained austenite are preferably as scarce as possible. The area fraction of pearlite is preferably 8% or less, and the area fraction of the retained austenite is preferably 3% or less. Note that the total of ferrite and martensite may be 100%, and other structures may be 0%.

Difference in Hardness Between Ferrite and Martensite: 1.0 GPa or More and 8.0 GPa or Less The difference in hardness between ferrite and martensite is a critical invention-constituting element in controlling the YR and the ductility. When the difference in hardness between ferrite and martensite is less than 1.0 GPa, the yield ratio YR increases. Meanwhile, when the difference in hardness between ferrite and martensite exceeds 8.0 GPa, the local ductility is degraded and thus the total elongation (El) is degraded. Therefore, the difference in hardness between ferrite and martensite is to be 1.0 GPa or more and 8.0 GPa or less and is preferably 1.5 GPa or more and 7.5 GPa or less.

The difference in hardness between ferrite and martensite is obtained as follows. After a sheet-thickness section (L section) parallel to the rolling direction of the steel sheet is polished, the section is corroded with a 1 vol. % nital, and, at a position ¼ of the sheet thickness (the position at a depth of ¼ of the sheet thickness from the steel sheet surface), the hardness of the ferrite phase and the hardness the martensite phase are each measured at five points with a micro hardness tester (DUH-W201S produced by Shimadzu Corporation) under the condition of a load of 0.5 gf so as to obtain the average hardness of each phase. The difference in hardness is calculated from the average hardness.

Inverse Intensity Ratio of γ-Fiber to the α-Fiber in Ferrite Texture: 0.8 or More and 7.0 or Less α-Fiber is a fibrous texture whose <110> axis is parallel to the rolling direction, and γ-fiber is a fibrous texture whose <111> axis is parallel to the normal direction of the rolled surface. A body-centered cubic metal is characterized in that α-fiber and γγ-fibers strongly develop due to rolling deformation, and the textures that belong to these fibers are formed even if recrystallization annealing is conducted.

In embodiments of the present invention, when the inverse intensity ratio of γ-fiber to the α-fiber in the ferrite texture exceeds 7.0, the texture orients in a particular direction of the steel sheet, and the planar anisotropy of mechanical properties, in particular, the planar anisotropy of the YP, is increased. Meanwhile, even when the inverse intensity ratio of γ-fiber to the α-fiber in the ferrite texture is less than 0.8, the planar anisotropy of mechanical properties, in particular, the planar anisotropy of the YP, is also increased. Thus, the inverse intensity ratio of γ-fiber to the α-fiber in the ferrite texture is to be 0.8 or more and 7.0 or less, and the upper limit of the intensity ratio is preferably 6.5 or less.

In the present invention, the inverse intensity ratio of γ-fiber to the α-fiber in the ferrite texture can be obtained as follows. After a sheet-thickness section (L section) parallel to the rolling direction of the steel sheet is wet-polished and buff-polished with a colloidal silica solution so as to make the surface smooth and flat, the section is corroded with a 0.1 vol. % nital so as to minimize irregularities on the sample surface and completely remove the work-deformed layer. Next, at a position ¼ of the sheet thickness (the position at a depth of ¼ of the sheet thickness from the steel sheet surface), crystal orientation is measured by SEM-EBSD (electron back-scatter diffraction), and, from the obtained data, the secondary phase containing martensite is eliminated by using the confidence index (CI) and image quality (IQ) by using OIM analysis available from AMETEK EDAX Company so as to extract only the ferrite texture. As a result, the inverse intensity ratio of the γ-fiber to the α-fiber of ferrite is calculated.

Average Size of Martensite: 1.0 μm or More and 15.0 μm or Less

When the average size of martensite is less than 1.0 μm, the increase in YR tends to be large. Meanwhile, when the average size of martensite exceeds 15.0 μm, the local ductility is degraded and thus the total elongation (El) is degraded. Thus; the average size of martensite is preferably 1.0 μm or more and 15.0 μm or less. The lower limit of the average size is more preferably 2.0 μm or more, and the upper limit of the average size is more preferably 10.0 μm or less.

The actual average size of martensite is calculated as follows. As in the observation of the phases described above, the observation position is set to the position of ¼ of the sheet thickness, the obtained steel sheet is observed with a SEM at a magnification of about ×1000, and the total area of the martensite phases within the observation view area is divided by the number of martensite phases by using Adobe Photoshop described above so as to calculate the average area of the martensite phases. The calculated average area is raised to the power of ½, and the result is assumed to be the average size of martensite.

Steel Sheet

The composition and the steel structure of the steel sheet are as described above. The thickness of the steel sheet is not particularly limited but is typically 0.3 mm or more and 2.8 mm or less.

Coated Steel Sheet

A coated steel sheet according to embodiments of the present invention is constituted by the steel sheet of the present invention and a coating layer on the steel sheet. The type of the coating layer is not particularly limited, and may be, for example, a hot-dip coating layer or an electrocoating layer. The coating layer may be an alloyed coating layer. The coating layer is preferably a zinc coating layer. The zinc coating layer may contain Al and Mg. A hot-dip zinc-aluminum-magnesium alloy coating (Zn—Al—Mg coating layer) is also preferable. In this case, the Al content is preferably 1 mass % or more and 22 mass % or less, the Mg content is preferably 0.1 mass % or more and 10 mass % or less, and the balance is preferably Zn. In the case of the Zn—Al—Mg coating layer, a total of 1 mass % or less of at least one element selected from Si, Ni, Ce, and La may be contained in addition to Zn, Al, and Mg. The coating metal is not particularly limited, and Al coating and the like may be used in addition to the Zn coating described above. The coating metal is not particularly limited, and Al coating and the like may be used in addition to the Zn coating described above.

The composition of the coating layer is also not particularly limited and may be any typical composition. For example, in the case of a galvanizing layer or a galvannealing layer, typically, the composition contains Fe: 20 mass % or less and Al: 0.001 mass % or more and 1.0 mass % or less, a total of 0 mass % or more and 3.5 mass % or less of one or more elements selected from Pb, Sb, Si, Sn, Mg, Mn, Ni, Cr, Co, Ca, Cu, Li, Ti, Be, Bi, and REM, and the balance being Zn and unavoidable impurities. In the present invention, a galvanizing layer having a coating weight of 20 to 80 $g/m^2$ per side, or a galvannealing layer obtained by alloying this galvanizing layer is preferably provided. When the coating layer is a galvanizing layer, the Fe content in the coating layer is less than 7 mass %, and when the coating layer is a galvannealing layer, the Fe content in the coating layer is 7 to 20 mass %.

Method for Producing Hot-Rolled Steel Sheet

A method for producing a hot-rolled steel sheet according to embodiments of the present invention includes heating a steel slab having the composition described above; rough-rolling the heated steel slab; in a subsequent finish-rolling, hot-rolling the rough-rolled steel slab under conditions a rolling reduction in the final pass of the finish rolling of 5% or more and 15% or less, a rolling reduction in the pass before the final pass of 15% or more and 25% or less, a finish-rolling inlet temperature of 1020° C. or higher and 1180° C. or lower, and a finish-rolling delivery temperature of 800° C. or higher and 1000° C. or lower; cooling the resulting hot-rolled steel sheet at an average cooling rate of 5° C./s or more and 90° C./s or less; and coiling the cooled steel sheet under a condition of a coiling temperature of 300° C. or higher and 700° C. or lower. In the description below, the temperature is a steel sheet surface temperature unless otherwise noted. The steel sheet surface temperature can be measured with a radiation thermometer or the like.

In the present invention, the method for melting the steel material (steel slab) is not particularly limited, and any know melting method such as one using a converter or an electric furnace is suitable. The casting method is also not particularly limited, but a continuous casting method is preferable. The steel slab (slab) is preferably produced by a continuous casting method to prevent macrosegregation, but can be produced by an ingot-making method, a thin-slab casting method, or the like. In addition to a conventional method that involves cooling the produced steel slab to room temperature and then re-heating the cooled steel slab, an energy-saving process, such as hot direct rolling, that involves directly charging a hot steel slab into a heating furnace without performing cooling to room temperature or rolling the steel slab immediately after very short recuperation can be employed without any issues. Moreover, the slab is formed into a sheet bar by rough-rolling under standard conditions; however, if the heating temperature is set relatively low, the sheet bar is preferably heated with a bar heater or the like before finish rolling in order to prevent troubles that occur during hot-rolling. In hot-rolling the slab, the slab may be re-heated in a heating furnace and then hot-rolled, or may be heated in a heating furnace at 1250° C. or higher for a short period of time and then hot-rolled.

The steel material (slab) obtained as such is subjected to hot-rolling. In this hot-rolling, only rough rolling and finish rolling may be performed, or only finish rolling may be performed without rough rolling. In either case, the rolling reduction in the final pass of the finish rolling, the rolling reduction in the pass immediately before the final pass, the finish-rolling inlet temperature, and the finish-rolling delivery temperature are important.

Rolling Reduction in Final Pass of Finish Rolling: 5% or More and 15% or Less

Rolling Reduction in Pass Before Final Pass: 15% or More and 25% or Less

In the present invention, by setting the rolling reduction in the pass before the final pass to be equal to or more than the rolling reduction in the final pass, the average crystal grain size of ferrite, the average size of martensite, and the texture can be appropriately controlled. Thus, the conditions of the rolling reductions are extremely important. When the rolling reduction in the final pass of the finish rolling is less than 5%, the ferrite crystal grains coarsen during hot-rolling, the crystal grains thereby coarsen in cold-rolling and subsequent annealing, and thus, the strength is degraded. Moreover, ferrite nucleation and growth occurs from very coarse austenite grains, and thus a so-called duplex-grained structure in which the generated ferrite grains vary in size is created. As a result, grains of a particular orientation grow during recrystallization annealing, resulting in an increase in YP planar anisotropy. Meanwhile, when the rolling reduction in the final pass exceeds 15%, the ferrite crystal grains become finer during hot-rolling, the ferrite crystal grains become finer in cold-rolling and subsequent annealing, and thus, the strength is increased. Moreover, the number of austenite nucleation sites increases at the time of annealing, fine martensite is generated, and, as a result, the YR is increased. Thus, the rolling reduction in the final pass of the finish rolling is set to be 5% or more and 15% or less.

When the rolling reduction in the pass before the final pass is less than 15%, a duplex-grained structure in which the generated ferrite grains vary in size is created despite rolling of the very coarse austenite grains in the final pass, and, as a result, grains of a particular orientation grow during recrystallization annealing, resulting in an increase in YP planar anisotropy. Meanwhile, when the rolling reduction in the pass before the final pass exceeds 25%, the ferrite crystal grains become finer during hot-rolling, the crystal grains become finer in cold-rolling and subsequent annealing, and thus, the strength is increased. Moreover, the number of austenite nucleation sites increases at the time of annealing, fine martensite is generated, and, as a result, the YR is increased. Thus, the rolling reduction in the pass before the final pass in the finish annealing is set to be 15% or more and 25% or less.

Finish-Rolling Inlet Temperature: 1020° C. or Higher and 1180° C. or Lower

The steel slab after heating is hot-rolled through rough rolling and finish rolling so as to form a hot-rolled steel sheet. During this process, when the finish-rolling inlet temperature exceeds 1180° C., the amount of oxides (scale) generated increases rapidly, the interface between the base iron and oxides is roughened, the scale separability during descaling or pickling is degraded, and thus the surface quality after annealing is deteriorated. Moreover, if unseparated hot-rolled scale remains in some parts after pickling, ductility is adversely affected. Meanwhile, at a finish-rolling inlet temperature lower than 1020° C., the finish-rolling temperature after finish-rolling decreases, the rolling load during hot-rolling increases, and the rolling workload increases, moreover, the rolling reduction while austenite is in an un-recrystallized state is increased, control of the texture after recrystallization annealing becomes difficult, and significant planar anisotropy is generated in the final product, thereby degrading the uniformity and stability of the materials. Furthermore, ductility itself is degraded. Thus, the finish-rolling inlet temperature of hot-rolling needs to be 1020° C. or higher and 1180° C. or lower. The finish-rolling inlet temperature is preferably 1020° C. or higher and 1160° C. or lower.

Finish-Rolling Delivery Temperature: 800° C. or Higher and 1000° C. or Lower

The steel slab after heating is hot-rolled through rough rolling and finish rolling so as to form a hot-rolled steel sheet. During this process, when the finish-rolling delivery temperature exceeds 1000° C., the amount of oxides (scale) generated increases rapidly, the interface between the base iron and oxides is roughened, and thus the surface quality after pickling and cold-rolling is deteriorated. Moreover, if unseparated hot-rolled scale remains in some parts after pickling, ductility is adversely affected. In addition, the crystal grains excessively coarsen, and the surface of a press product may become rough during working. Meanwhile, when the finish-rolling delivery temperature is lower than 800° C., the rolling load increases, the rolling workload increases, the rolling reduction while austenite is in an un-recrystallized state increases, an abnormal texture develops, and significant planar anisotropy is generated in the final product, thereby degrading the uniformity and stability of the materials. Furthermore, ductility itself is degraded. Workability is degraded when the finish-rolling delivery temperature is lower than 800° C. Thus, the finish-rolling delivery temperature hot-rolling needs to be 800° C. or higher and 1000° C. or lower. The lower limit of the finish-rolling delivery temperature is preferably 820° C. or higher. The upper limit of the finish-rolling delivery temperature is preferably 950° C. or lower.

As mentioned above, in this hot-rolling, only rough rolling and finish rolling may be performed, or only finish rolling may be performed without rough rolling.

Average cooling rate from after finish-rolling to coiling temperature: 5° C./s or more and 90° C./s or less By appropriately controlling the average cooling rate from after finish-rolling to the coiling temperature, the crystal grains of the phases in the hot-rolled steel sheet can be made finer, and, after the subsequent cold rolling and annealing, cumulation the texture can be increased in the {111}//ND direction (in other words, the inverse intensity ratio of the γ-fiber to the α-fiber can be adjusted). Here, if the average cooling rate from after finish-rolling to the coiling temperature exceeds 90° C./s, the shape of the sheet is significantly degraded, and problems may arise in the subsequent cold-rolling or annealing (heating and cooling process after cold-rolling) in the subsequent cold-rolling or annealing. Meanwhile, if the rate is less than 5° C./s, the crystal grain size in the hot-rolled sheet structure increases, and cumulation into γ-fiber cannot be enhanced in the texture after the subsequent cold-rolling and annealing. Moreover, coarse carbides are formed during hot-rolling, and remain even after annealing, which degrades workability. Thus, the average cooling rate from after the finish-rolling to the coiling temperature is set to be 5° C./s or more and 90° C./s or less, and the lower limit of the average cooling rate is preferably 7° C./s or more and more preferably 9° C./s or more. The upper limit of the average cooling rate is preferably 60° C./s or less and more preferably 50° C./s or less.

Coiling Temperature: 300° C. or Higher and 700° C. or Lower

When the coiling temperature after hot-rolling exceeds 700° C., the ferrite crystal grain size in the steel structure of the hot-rolled sheet (hot-rolled steel sheet) increases, and after annealing, it becomes difficult to obtain the desired strength. Meanwhile, when the coiling temperature after the hot-rolling is lower than 300° C., the hot-rolled sheet strength increases, the rolling workload during cold-rolling increases, the productivity is degraded. Moreover, when a hard hot-rolled steel sheet mainly composed of martensite is cold-rolled, minute inner cracking (brittle cracking) is likely to occur along the former austenite grain boundaries of martensite, and the ductility and the stretch flangeability of the final product, annealed sheet, are degraded. Thus, the coiling temperature after hot-rolling needs to be 300° C. or higher and 700° C. or lower. The lower limit of the coiling temperature is preferably 400° C. or higher. The upper limit of the coiling temperature is preferably 650° C. or lower.

During hot-rolling, rough-rolled sheets may be joined with each other and finish-rolling may be conducted continuously. Moreover, the rough-rolled sheet may be temporarily coiled. Furthermore, in order to decrease the rolling load during hot-rolling, part or the entirety of the finish-rolling may be lubricated. Performing lubricated rolling is also effective from the viewpoints of uniformity of the steel sheet shape and uniformity of the material. The coefficient of friction during lubricated rolling is preferably in the range of 0.10 or more and 0.25 or less.

Method for Producing Cold-Rolled Full Hard Steel Sheet

A method for producing cold-rolled full hard steel sheet according to embodiments of the present invention involves pickling the hot-rolled steel sheet described above and cold-rolling the pickled steel sheet at a rolling reduction of 35% or more.

Pickling can remove oxides on the steel sheet surface, and thus is critical for ensuring excellent chemical conversion treatability and coating quality of the final products, such as steel sheets and coated steel sheets. Pickling may be performed once, or in fractions several times.

Rolling Reduction in Cold-Rolling Step (Rolling Reduction): 35% or More

Cold-rolling after hot-rolling causes the α-fiber and the γ-fiber to develop and thereby increases the amount of ferrite having the α-fiber and the γ-fiber, in particular, ferrite having the γ-fiber, in a structure after annealing, and, thus, the YP planar anisotropy can be decreased. In order to achieve such effects, the lower limit of the rolling reduction for cold-rolling is set to be 35%. From the viewpoint of decreasing the YP planar anisotropy, the rolling reduction during cold-rolling is preferably 40% or more, more preferably 45% or more, and yet more preferably 49% or more. Note that the number of times the rolling pass is performed, and the rolling reduction of each pass are not particularly limited in obtaining the effects of the present invention. The upper limit of the rolling reduction is not particularly limited, but, from the industrial viewpoint, is about 80%.

Method for Producing Steel Sheet

The method for producing steel sheet is a method (one-stage method) with which a hot-rolled steel sheet or a cold-rolled full hard steel sheet is heated and cooled (i.e., performing annealing once) to produce a steel sheet, or a method (two-stage method) with which a hot-rolled steel sheet or a cold-rolled full hard steel sheet is heated and cooled (first annealing) to form a heat-treated sheet, and the heat-treated sheet is heated and cooled (second annealing) to form a steel sheet. In the description below, the first annealing (one-stage method) is described first.

Maximum Attained Temperature: T1 Temperature or Higher and T2 Temperature or Lower When the maximum attained temperature is lower than the T1 temperature, this annealing is performed in the ferrite single phase region, and thus, the secondary phase containing martensite is not generated after annealing, the desired strength cannot be obtained, and the YR is increased. Meanwhile, when the maximum attained temperature exceeds the T2 temperature, the secondary phase containing martensite generated after annealing is increased, the strength is increased, and the ductility is degraded. Thus, the maximum attained temperature is set to be the T1 temperature or higher and the T2 temperature or lower.

$$T1 \text{ temperature } (^\circ \text{ C.}) = 745 + 29 \times [\%\ \text{Si}] - 21 \times [\%\ \text{Mn}] + 17 \times [\%\ \text{Cr}]$$

$$T2 \text{ temperature } (^\circ \text{ C.}) = 960 - 203 \times [\%\ \text{C}]^{1/2} + 45 \times [\%\ \text{Si}] - 30 \times [\%\ \text{Mn}] + 150 \times [\%\ \text{Al}] - 20 \times [\%\ \text{Cu}] + 11 \times [\%\ \text{Cr}] + 350 \times [\%\ \text{Ti}] + 104 \times [\%\ \text{V}]$$

In the formulae above, [% X] denotes the content (mass %) of the component element X in the steel sheet.

The holding time for holding the maximum attained temperature is not particularly limited but is preferably 10 s or longer and 40000 s or shorter.

Residence Time in Temperature Range of [Maximum Attained Temperature—50° C.] to Maximum Attained Temperature: 500 s or Less When the residence time in the temperature range of [maximum attained temperature—50° C.] to the maximum attained temperature exceeds 500 s, the desired properties are not obtained. The lower limit of the residence time in the temperature range of [maximum attained temperature—50° C.] to the maximum attained temperature is not particularly limited. However, if the residence time is less than 30 seconds, recrystallization of ferrite is insufficient, and the YP planar anisotropy may increase. Thus, the residence time is preferably 30 seconds or more and more preferably 50 seconds or more.

Average Cooling Rate in Temperature Range of [T1 Temperature—10° C.] to 550° C.: 3° C./s or More During cooling after holding described above, when the average cooling rate in the temperature range of [T1 temperature—10° C.] to 550° C. is less than 3° C./s, ferrite and pearlite occur excessively during cooling, and the desired amount of martensite is not obtained. Thus, the average cooling rate in the temperature range of [T1 temperature—10° C.] to 550° C. is set to be 3° C./s or more.

Dew Point in Temperature Range of 600° C. or Higher: −40° C. or Lower

During annealing, when the dew point in the temperature range of 600° C. or higher is high, decarburization proceeds through moisture in the air, the ferrite grains in the steel sheet surface layer portion coarsen, and the hardness is degraded; thus, excellent tensile strength is not stably obtained and the bending fatigue properties are degraded in some cases. Moreover, when coating is to be performed, the elements, such as Si and Mn, that obstruct coating concentrate in the steel sheet surface during annealing, and the coatability is obstructed. Thus, the dew point in the temperature range of 600° C. or higher during annealing needs to be −40° C. or lower. More preferably, the dew point is −45° C. or lower. In the typical annealing process that involves heating, soaking, and cooling steps, the dew point in the temperature range of 600° C. or higher needs to be −40° C. or lower in all the steps. The lower limit of the dew point in the atmosphere is not particularly limited, but when the lower limit is lower than −80° C., the effect is saturated and there is a cost disadvantage. Thus, the lower limit is preferably −80° C. or higher. The temperature in the temperature ranges described above is based on the steel sheet surface temperature. In other words, the dew point is adjusted to be within the above-described range when the steel sheet surface temperature is within the above-described temperature range.

The cooling stop temperature during cooling is not particularly limited but is typically 120 to 550° C.

Next, the process in which annealing is performed twice (two-stage method) is described. In the two-stage method, first, a hot-rolled steel sheet or a cold-rolled full hard steel sheet is heated to prepare a heat-treated sheet. The method for obtaining this heat-treated sheet is the method for producing a heat-treated sheet according to embodiments of the present invention.

A specific method for obtaining the heat-treated sheet described above is a method that includes heating a hot-rolled steel sheet or a cold-rolled full hard steel sheet under conditions of a maximum attained temperature of a T1 temperature or higher and a T2 temperature or lower and a residence time of 500 s or less in a temperature range of [maximum attained temperature—50° C.] to the maximum attained temperature; and then cooling the heated sheet and pickling the cooled sheet.

The technical significance of the maximum attained temperature and the residence time is the same as the one-stage method, and thus the description therefor is omitted. In order to obtain a heat-treated sheet, after holding for the above-described residence time, cooling and pickling are performed.

The cooling rate during the cooling is not particularly limited but is typically 5 to 350° C./s.

Since the elements, such as Si and Mn, that obstruct coating concentrate in the surface during re-heating of the heat-treated sheet described below, and the coatability is deteriorated thereby, the high-concentration surface layer needs to be removed by pickling or the like. However, whether or not descaling by pickling is performed after coiling after hot-rolling does not affect the effects of the present invention in any way. In order to improve sheet passability, skinpass rolling may be performed on the heat-treated sheet before the pickling.

Re-Heating Temperature: T1 Temperature or Higher

In the two-stage method, recrystallization of ferrite is completed in the first heating process; thus, the re-heating temperature may be equal to or higher than the T1 temperature. However, at a temperature lower than the T1 temperature, formation of austenite becomes insufficient, and it becomes difficult to obtain the desired amount of martensite. Thus, the re-heating temperature is set to be equal to higher than the T1 temperature. The upper limit of the re-heating temperature is not particularly limited, but when the upper limit exceeds 850° C., the elements such as Si and Mn concentrate in the surface again and may degrade the coatability. Thus, the upper limit is preferably 850° C. or lower. More preferably, the upper limit is 840° C. or lower.

Average Cooling Rate in Temperature Range of [T1 Temperature—10° C.] to 550° C.: 3° C./s or More During cooling after re-heating described above, when the average cooling rate in the temperature range of [T1 temperature—10° C.] to 550° C. is less than 3° C./s, ferrite and pearlite occur excessively during cooling, the desired amount of martensite is not obtained, and YR is increased. Thus, the average cooling rate in the temperature range of [T1 temperature—10° C.] to 550° C. is set to be 3° C./s or more. The upper limit of the average cooling rate in the temperature range of 450° C. to [T1 temperature—10° C.] is not particularly limited, but is preferably 100° C./s or lower since at a rate exceeding 100° C./s, the sheet shape is degraded due to rapid heat shrinkage, and this may pose operational issues such as transverse displacement.

Dew Point in Temperature Range of 600° C. or Higher: −40° C. or Lower

During annealing, when the dew point in the temperature range of 600° C. or higher is high, decarburization proceeds through moisture in the air, the ferrite grains in the steel sheet surface layer portion coarsen, and the hardness is degraded; thus, excellent tensile strength is not stably obtained and the bending fatigue properties are degraded in some cases. Moreover, when coating is to be performed, the elements, such as Si and Mn, that obstruct coating concentrate in the steel sheet surface during annealing, and the coatability is obstructed. Thus, the dew point in the temperature range of 600° C. or higher during annealing needs to be −40° C. or lower. More preferably, the dew point is −45° C. or lower. In the typical annealing process that involves heating, soaking, and cooling steps, the dew point in the temperature range of 600° C. or higher needs to be −40° C. or lower in all the steps. The lower limit of the dew point in the atmosphere is not particularly limited, but when the lower limit is lower than −80° C., the effect is saturated and there is a cost disadvantage. Thus, the lower limit is preferably −80° C. or higher. The temperature in the temperature ranges described above is based on the steel sheet surface temperature. In other words, the dew point is adjusted to be within the above-described range when the steel sheet surface temperature is within the above-described temperature range.

The steel sheet obtained in the one-stage method or the two-stage method described above may be subjected to skinpass rolling. The skinpass rolling ratio is more preferably 0.1% or more and 1.5% or less since at less than 0.1%, the elongation at yield does not disappear, and at a ratio exceeding 1.5%, the yield stress of the steel increases and the YR is increased.

When the steel sheet is the subject of the trade, the steel sheet is usually cooled to room temperature, and then traded.

Method for Producing Coated Steel Sheet

The method for producing a coated steel sheet according to embodiments of the present invention is the method that involves performing coating on the steel sheet. Examples of the coating process include a galvanizing process, and a galvannealing process. Annealing and galvanizing may be continuously performed using one line. Alternatively, the coating layer may be formed by electroplating, such as Zn—Ni alloy electroplating, or the steel sheet may be coated with hot-dip zinc-aluminum-magnesium alloy. Although galvanizing is mainly described herein, the type of coating metal is not limited and may be Zn coating or Al coating.

In performing the galvanizing process, the steel sheet is dipped in a zinc coating bath at 440° C. or higher and 500° C. or lower to galvanize the steel sheet, and the coating weight is adjusted by gas wiping or the like. In galvanizing, a zinc coating bath having an Al content of 0.10 mass % or more and 0.23 mass % or less is preferably used. In performing the galvannealing process, the zinc coating is subjected to an alloying process in a temperature range of 470° C. or higher and 600° C. or lower after galvanizing. When the alloying process is performed at a temperature exceeding 600° C., untransformed austenite transforms into pearlite, and the TS may be degraded. Thus, in performing the galvannealing process, the alloying process is preferably performed in a temperature range of 470° C. or higher and 600° C. or lower. Moreover, an electrogalvanizing process may be performed. The coating weight per side is preferably 20 to 80 g/m$^2$ (coating is performed on both sides), and the galvannealed steel sheet (GA) is preferably subjected to the following alloying process so as to adjust the Fe concentration in the coating layer to 7 to 15 mass %.

The rolling reduction in skinpass rolling after the coating process is preferably in the range of 0.1% or more and 2.0% or less. At a rolling reduction of less than 0.1%, the effect is small and control is difficult; and thus, 0.1% is the lower limit of the preferable range. At a rolling reduction exceeding 2.0%, the productivity is significantly degraded, and thus 2.0% is the upper limit of the preferable range. Skinpass rolling may be performed on-line or off-line. Skinpass may be performed once at a targeted rolling reduction, or may be performed in fractions several times.

Other conditions of the production methods are not particularly limited; however, from the productivity viewpoint, a series of processes such as annealing, galvanizing, galvannealing, etc., are preferably performed in a continuous galvanizing line (CGL). After galvanizing, wiping can be performed to adjust the coating weight. The conditions of the coating etc., other than the conditions described above may the typical conditions for galvanization.

Examples

Steels each having a composition indicated in Table 1 with the balance being Fe and unavoidable impurities were smelted in a converter, and prepared into slabs by a continuous casting method. Thus obtained slab was heated, hot-rolled under the conditions indicated in Table 2, pickled, and in Nos. 1 to 18, 20 to 25, 27, 28, and 30 to 35, cold-rolled.

Next, an annealing process was performed under the conditions indicated in Table 2 so as to obtain steel sheets (those samples having marks in the pre-annealing column are prepared by the two-stage method).

Some of the steel sheets were subjected to a coating process so as to obtain galvanized steel sheets (GI), galvannealed steel sheets (GA), electrogalvanized steel sheets (EG), hot-dip zinc-aluminum-magnesium alloy coated steel sheets (ZAM), etc. A zinc bath with Al: 0.14 to 0.19 mass % was used as the galvanizing bath for GI, and a zinc bath with Al: 0.14 mass % was used for GA. The bath temperature was 470° C. The coating weight was about 45 to 72 g/m$^2$ per side (both sides were coated) for GI and about 45 g/m$^2$ per side (both sides were coated) for GA. In GA, the Fe concentration in the coating layer was adjusted to 9 mass % or more and 12 mass % or less. In EG with a Zn—Ni coating layer as the coating layer, the Ni content in the coating layer was adjusted to 9 mass % or more and 25 mass % or less. In ZAM with a Zn—Al—Mg coating layer as the coating layer, the Al content in the coating layer was adjusted to 3 mass % or more and 22 mass % or less, and the Mg content was adjusted to 1 mass % or more and 10 mass % or less.

The T1 temperature (° C.) was obtained from the following formula:

$$T1 \text{ temperature } (^\circ \text{C.}) = 745 + 29 \times [\%\ \text{Si}] - 21 \times [\%\ \text{Mn}] + 17 \times [\%\ \text{Cr}]$$

The T2 temperature (° C.) can be calculated as follows.

$$T2 \text{ temperature } (^\circ \text{C.}) = 960 - 203 \times [\%\ \text{C}]^{1/2} + 45 \times [\%\ \text{Si}] - 30 \times [\%\ \text{Mn}] + 150 \times [\%\ \text{Al}] - 20 \times [\%\ \text{Cu}] + 11 \times [\%\ \text{Cr}] + 350 \times [\%\ \text{Ti}] + 104 \times [\%\ \text{V}]$$

In the formulae above, [% X] denotes the mass % of the component element X in the steel sheet.

TABLE 1

| Steel type | Composition (mass %) C | Si | Mn | P | S | Al | N | Mo | Ti | Nb | V | B | Cr | Cu | Ni | As |
|---|---|---|---|---|---|---|---|---|---|---|---|---|---|---|---|---|
| A | 0.090 | 0.02 | 1.78 | 0.008 | 0.0018 | 0.059 | 0.0032 | — | — | — | — | — | — | — | — | — |
| B | 0.058 | 0.17 | 1.82 | 0.022 | 0.0032 | 0.060 | 0.0034 | — | — | — | — | — | — | — | — | — |
| C | 0.040 | 0.01 | 2.35 | 0.020 | 0.0043 | 0.044 | 0.0012 | — | — | — | — | — | — | — | — | — |
| D | 0.091 | 0.01 | 1.78 | 0.044 | 0.0043 | 0.069 | 0.0011 | — | — | — | — | — | — | — | — | — |
| E | 0.044 | 0.02 | 2.12 | 0.020 | 0.0048 | 0.084 | 0.0046 | 0.18 | — | — | — | — | — | — | — | — |
| F | 0.024 | 0.08 | 1.80 | 0.030 | 0.0031 | 0.061 | 0.0034 | — | — | — | — | — | — | — | — | — |
| G | 0.067 | 0.03 | 1.29 | 0.013 | 0.0050 | 0.077 | 0.0019 | — | — | — | — | — | — | — | — | — |
| H | 0.068 | 0.09 | 3.28 | 0.046 | 0.0025 | 0.034 | 0.0040 | — | — | — | — | — | — | — | — | — |
| I | 0.033 | 0.03 | 2.08 | 0.006 | 0.0013 | 0.098 | 0.0017 | — | 0.045 | — | — | — | — | — | — | — |
| J | 0.067 | 0.02 | 2.16 | 0.025 | 0.0037 | 0.037 | 0.0031 | — | — | 0.031 | — | — | — | — | — | — |
| K | 0.075 | 0.01 | 2.17 | 0.005 | 0.0043 | 0.041 | 0.0025 | — | — | — | 0.042 | — | — | — | — | — |
| L | 0.051 | 0.08 | 1.86 | 0.011 | 0.0031 | 0.042 | 0.0019 | — | 0.021 | — | — | 0.0011 | — | — | — | — |
| M | 0.125 | 0.01 | 2.17 | 0.023 | 0.0046 | 0.099 | 0.0014 | — | — | — | — | — | 0.36 | — | — | — |
| N | 0.053 | 0.01 | 2.32 | 0.006 | 0.0016 | 0.038 | 0.0032 | — | — | — | — | — | — | 0.25 | — | — |
| O | 0.067 | 0.02 | 1.97 | 0.030 | 0.0045 | 0.046 | 0.0047 | — | — | — | — | — | — | — | — | — |
| P | 0.079 | 0.09 | 1.84 | 0.047 | 0.0025 | 0.032 | 0.0017 | — | — | — | — | — | — | — | 0.09 | 0.007 |
| Q | 0.123 | 0.02 | 1.88 | 0.028 | 0.0043 | 0.053 | 0.0026 | — | — | — | — | — | — | — | — | — |
| R | 0.062 | 0.05 | 1.90 | 0.013 | 0.0032 | 0.096 | 0.0024 | — | — | 0.042 | — | — | — | — | — | — |
| S | 0.048 | 0.02 | 1.83 | 0.035 | 0.0025 | 0.068 | 0.0017 | — | — | 0.035 | — | — | — | — | — | — |
| T | 0.064 | 0.02 | 1.82 | 0.018 | 0.0019 | 0.073 | 0.0044 | — | — | 0.046 | — | — | — | — | — | — |
| U | 0.055 | 0.08 | 2.30 | 0.018 | 0.0027 | 0.089 | 0.0014 | — | — | — | — | — | — | — | — | — |
| V | 0.043 | 0.02 | 1.83 | 0.027 | 0.0029 | 0.077 | 0.0025 | — | — | — | — | — | — | — | — | — |
| W | 0.079 | 0.02 | 1.80 | 0.033 | 0.0046 | 0.090 | 0.0037 | — | — | — | — | — | — | — | — | — |
| X | 0.067 | 0.29 | 2.09 | 0.014 | 0.0014 | 0.054 | 0.0012 | — | — | — | — | — | — | — | — | — |

| Steel type | Composition (mass %) Sb | Sn | Ta | Ca | Mg | Zn | Co | Zr | REM | T1 temperature (° C.) | T2 temperature (° C.) | Remarks |
|---|---|---|---|---|---|---|---|---|---|---|---|---|
| A | — | — | — | — | — | — | — | — | — | 708 | 855 | Invention steel |
| B | — | — | — | — | — | — | — | — | — | 712 | 873 | Invention steel |
| C | — | — | — | — | — | — | — | — | — | 696 | 856 | Invention steel |
| D | — | — | — | — | — | — | — | — | — | 708 | 856 | Invention steel |
| E | — | — | — | — | — | — | — | — | — | 701 | 867 | Invention steel |
| F | — | — | — | — | — | — | — | — | — | 709 | 887 | Comparative steel |
| G | — | — | — | — | — | — | — | — | — | 719 | 881 | Comparative steel |
| H | — | — | — | — | — | — | — | — | — | 679 | 818 | Comparative steel |
| I | — | — | — | — | — | — | — | — | — | 702 | 893 | Invention steel |
| J | — | — | — | — | — | — | — | — | — | 700 | 849 | Invention steel |
| K | — | — | — | — | — | — | — | | — | 700 | 850 | Invention steel |
| L | — | — | — | — | — | — | — | | — | 708 | 876 | Invention steel |
| M | — | — | — | — | — | — | — | | — | 706 | 843 | Invention steel |
| N | — | — | — | — | — | — | — | | — | 697 | 845 | Invention steel |
| O | 0.005 | — | — | — | — | — | — | | — | 704 | 856 | Invention steel |
| P | — | 0.006 | — | — | — | — | — | | — | 709 | 857 | Invention steel |
| Q | — | — | 0.006 | — | — | — | — | | — | 706 | 841 | Invention steel |
| R | 0.006 | — | — | — | — | — | — | | — | 707 | 870 | Invention steel |
| S | — | 0.004 | — | — | — | — | — | | — | 707 | 872 | Invention steel |
| T | — | — | 0.006 | — | — | — | — | | — | 707 | 866 | Invention steel |
| U | — | — | — | 0.0034 | — | — | — | 0.004 | — | 699 | 860 | Invention steel |
| V | — | — | — | — | 0.0037 | 0.011 | 0.005 | — | — | 707 | 875 | Invention steel |
| W | — | — | — | — | — | — | — | — | 0.0026 | 708 | 863 | Invention steel |
| X | — | — | — | — | — | — | — | — | — | 710 | 866 | Invention steel |

TABLE 2

| No. | Steel type | Finish-rolling inlet temperature (° C.) | Pass immediately before final pass (%) | Final pass (%) | Finish-rolling delivery temperature (° C.) | Average cooling rate from after finish rolling to coiling temperature (° C./s) | Coiling temperature (° C.) | Whether cold-rolling is performed (Yes/No) | Rolling reduction in cold-rolling (%) | Pre-annealing conditions Residence time (s) |
|---|---|---|---|---|---|---|---|---|---|---|
| 1 | A | 1020 | 19 | 9 | 870 | 30 | 510 | Yes | 52 | — |
| 2 | B | 1030 | 22 | 13 | 880 | 22 | 590 | Yes | 66 | 10 |
| 3 | C | 1150 | 20 | 10 | 890 | 17 | 530 | Yes | 55 | — |
| 4 | C | 970 | 21 | 12 | 890 | 22 | 630 | Yes | 52 | — |
| 5 | C | 1100 | 20 | 4 | 920 | 24 | 630 | Yes | 60 | — |

TABLE 2-continued

| | | | | | | | | | | |
|---|---|---|---|---|---|---|---|---|---|---|
| 6 | C | 1060 | 22 | 12 | 780 | 19 | 490 | Yes | 52 | — |
| 7 | C | 1160 | 23 | 11 | 860 | 3 | 450 | Yes | 52 | 20 |
| 8 | C | 1080 | 21 | 9 | 890 | 15 | 630 | Yes | 32 | — |
| 9 | C | 1030 | 23 | 10 | 920 | 35 | 600 | Yes | 58 | 510 |
| 10 | C | 1150 | 21 | 10 | 930 | 28 | 530 | Yes | 70 | 10 |
| 11 | C | 1060 | 20 | 12 | 900 | 22 | 530 | Yes | 65 | — |
| 12 | C | 1050 | 19 | 10 | 910 | 13 | 510 | Yes | 52 | — |
| 13 | C | 1040 | 20 | 11 | 860 | 15 | 500 | Yes | 52 | 10 |
| 14 | C | 1060 | 22 | 9 | 880 | 12 | 530 | Yes | 52 | — |
| 15 | D | 1040 | 22 | 12 | 870 | 10 | 580 | Yes | 54 | 5 |
| 16 | E | 1160 | 20 | 12 | 850 | 25 | 590 | Yes | 55 | — |
| 17 | F | 1050 | 21 | 12 | 970 | 15 | 570 | Yes | 60 | — |
| 18 | G | 1060 | 23 | 12 | 870 | 40 | 490 | Yes | 55 | 10 |
| 19 | H | 1060 | 22 | 13 | 850 | 13 | 620 | No | 0 | — |
| 20 | I | 1150 | 19 | 10 | 880 | 23 | 540 | Yes | 60 | 10 |
| 21 | J | 1160 | 23 | 13 | 910 | 26 | 590 | Yes | 60 | 20 |
| 22 | K | 1040 | 22 | 10 | 900 | 25 | 500 | Yes | 70 | 15 |
| 23 | L | 1060 | 20 | 10 | 900 | 21 | 510 | Yes | 49 | — |
| 24 | M | 1050 | 21 | 11 | 900 | 19 | 500 | Yes | 59 | — |
| 25 | N | 1060 | 21 | 12 | 890 | 32 | 560 | Yes | 60 | 15 |
| 26 | O | 1030 | 21 | 10 | 860 | 34 | 600 | No | 0 | — |
| 27 | P | 1160 | 21 | 12 | 890 | 18 | 470 | Yes | 59 | 10 |
| 28 | Q | 1050 | 22 | 13 | 880 | 20 | 560 | Yes | 60 | — |
| 29 | R | 1060 | 23 | 12 | 860 | 21 | 600 | No | 0 | 10 |
| 30 | S | 1040 | 20 | 11 | 850 | 10 | 520 | Yes | 60 | 2 |
| 31 | T | 1150 | 22 | 10 | 920 | 15 | 420 | Yes | 60 | — |
| 32 | U | 1030 | 22 | 12 | 910 | 9 | 520 | Yes | 69 | — |
| 33 | V | 1060 | 19 | 9 | 850 | 14 | 580 | Yes | 60 | 5 |
| 34 | W | 1060 | 22 | 11 | 880 | 18 | 530 | Yes | 52 | 35 |
| 35 | X | 1150 | 21 | 10 | 920 | 21 | 620 | Yes | 60 | — |

| | Annealing conditions | | | | | | | |
|---|---|---|---|---|---|---|---|---|
| No. | Pre-annealing conditions Maximum attained temperature (° C.) | Dew point in temperature range of 600° C. or higher (° C.) | Residence time*1 (s) | Maximum attained temperature (° C.) | Average cooling rate*2 (° C./s) | Presence of coating (Yes/No) | Type of coating etc. (*) | Remarks |
| 1 | — | −44 | 10 | 810 | 25 | No | CR | Example |
| 2 | 820 | −48 | — | 770 | 12 | Yes | GA | Example |
| 3 | — | −47 | 10 | 830 | 16 | Yes | GI | Example |
| 4 | — | −45 | 20 | 800 | 30 | Yes | GA | Comparative Example |
| 5 | — | −43 | 15 | 830 | 25 | No | CR | Comparative Example |
| 6 | — | −47 | 5 | 820 | 20 | Yes | GA | Comparative Example |
| 7 | 810 | −47 | — | 750 | 15 | No | CR | Comparative Example |
| 8 | — | −41 | 10 | 810 | 18 | Yes | GA | Comparative Example |
| 9 | 800 | −47 | — | 750 | 25 | Yes | EG | Comparative Example |
| 10 | 670 | −47 | — | 770 | 15 | Yes | GA | Comparative Example |
| 11 | — | −38 | 15 | 825 | 25 | Yes | GA | Comparative Example |
| 12 | — | −47 | 520 | 800 | 15 | No | CR | Comparative Example |
| 13 | 800 | −47 | — | 675 | 20 | No | CR | Comparative Example |
| 14 | — | −47 | 10 | 800 | 2 | Yes | GA | Comparative Example |
| 15 | 820 | −48 | — | 750 | 15 | Yes | GI | Example |
| 16 | — | −50 | 10 | 800 | 25 | Yes | GA | Example |
| 17 | — | −51 | 10 | 780 | 15 | Yes | GA | Comparative Example |
| 18 | 820 | −47 | — | 750 | 15 | No | CR | Comparative Example |
| 19 | — | −47 | 10 | 780 | 12 | Yes | GI | Comparative Example |
| 20 | 800 | −45 | — | 760 | 20 | Yes | GA | Example |
| 21 | 830 | −46 | — | 750 | 25 | No | CR | Example |
| 22 | 845 | −48 | — | 760 | 25 | Yes | GA | Example |
| 23 | — | −47 | 33 | 750 | 15 | Yes | GI | Example |
| 24 | — | −47 | 10 | 835 | 15 | Yes | GI | Example |
| 25 | 800 | −45 | — | 750 | 33 | No | CR | Example |
| 26 | — | −55 | 20 | 780 | 5 | Yes | EG | Example |
| 27 | 800 | −50 | — | 720 | 15 | Yes | GA | Example |
| 28 | — | −51 | 3 | 750 | 20 | No | CR | Example |
| 29 | 770 | −51 | — | 770 | 25 | Yes | GA | Example |
| 30 | 820 | −50 | | 750 | 12 | No | CR | Example |
| 31 | — | −41 | 10 | 830 | 20 | Yes | GI | Example |
| 32 | — | −45 | 5 | 800 | 15 | Yes | ZAM | Example |
| 33 | 790 | −46 | — | 750 | 18 | Yes | GA | Example |
| 34 | 800 | −47 | — | 760 | 15 | Yes | GA | Example |
| 35 | — | −45 | 15 | 760 | 15 | No | CR | Example |

(*) CR: cold-rolled steel sheet (not coated), GI: galvanized steel sheet (not subjected to galvannealing), GA: galvannealed steel sheet, EG: electrogalvanized steel sheet, ZAM: hot-dip zinc-aluminum-magnesium alloy coated steel sheet

*1Residence time in a temperature range of [maximum attained temperature −50° C.] to maximum attained temperature

*2Average cooling rate in a temperature range of [T1 temperature - 10° C.] to 550° C.

The steel sheets and the high-strength coated steel sheets obtained as above were used as sample steels to evaluate their mechanical properties. The mechanical properties were evaluated by the following tensile test. The results are indicated in Table 3. The sheet thickness of the each steel sheet, which is a sample steel sheet, is also indicated in Table 3.

JIS No. 5 test pieces taken so that the longitudinal direction of the test pieces was in three directions, namely, the rolling direction (L direction) of the steel sheet, a direction (D direction) 45° with respect to the rolling direction of the steel sheet, and a direction (C direction) 90° with respect to the rolling direction of the steel sheet, were used to perform a tensile test in accordance with JIS Z 2241 (2011), and the YP (yield stress), the TS (tensile strength), and El (total elongation) were measured. For the purposes of the present invention, the ductility, i.e., El (total elongation), is evaluated as satisfactory when the product, TS×El, was 15000 MPa·% or more. The YR was evaluated as satisfactory when YP=(YP/TS)×100 was as low as 75% or less. The YP planar anisotropy was evaluated as satisfactory when the value of |ΔYP|, which is an index of the YP planar anisotropy, was 50 MPa or less. YP, TS, and El indicated in Table 3 are the measurement results of the test pieces taken in the C direction. |ΔYP| was calculated by the above-described calculation method.

The area fractions of ferrite and martensite, the average crystal grain size of ferrite, the difference in hardness between ferrite and martensite, and the average size of martensite were obtained by the methods described above. The inverse intensity ratio of the γ-fiber to the α-fiber in the ferrite texture at a position ¼ of the thickness of the steel sheet was obtained by the method described above. The rest of the structure was confirmed by a typical method and indicated in Table 3.

The coatability was evaluated as satisfactory when the coating defect length incidence per 100 coils was 0.8% or less. The coating defect length incidence is determined by formula (2) below, and the surface properties were observed with a surface tester and evaluated as "excellent" when the scale defect length incidence per 100 coils was 0.2% or less, "fair" when the incidence was more than 0.2% but not more than 0.8%, and "poor" when the incidence was more than 0.8%.

$$\text{(Coating defect length incidence)}=\text{(total length of defects determined to be bare defects in } L \text{ direction)/(delivery-side coil length)}\times 100 \quad (2)$$

As indicated in Table 3, in Examples of the present invention, TS was 540 MPa or more, the ductility was excellent, the yield ratio (YR) was low, and the YP planar anisotropy and coatability were also excellent. In contrast, in Comparative Examples, at least one of the strength, the YR, the balance between the strength and the ductility, the YP planar anisotropy, and the coatability was poor.

Although the embodiments of the present invention are described heretofore, the present invention is not limited by the description of the embodiments, which constitutes part of the disclosure of the present invention. In other words, other embodiments, examples, and implementation techniques practiced by a person skilled in the art and the like on the basis of the embodiments are all within the scope of the present invention. For example, in a series of heat treatments in the production methods described above, the facilities in which the steel sheet is heat-treated and the like are not particularly limited as long as the heat history conditions are satisfied.

TABLE 3

| No. | Steel type | Sheet thickness (mm) | F area fraction (%) | M area fraction (%) | Difference in hardness between F and M (GPa) | F average crystal grain size (μm) | M average size (μm) | γ-Fiber-to-α-fiber inverse intensity ratio in F | Rest of structure |
|---|---|---|---|---|---|---|---|---|---|
| 1 | A | 1.4 | 81.9 | 11.4 | 2.8 | 24.6 | 6.2 | 4.9 | θ |
| 2 | B | 1.0 | 82.3 | 7.4 | 2.6 | 14.4 | 8.0 | 6.0 | θ |
| 3 | C | 1.4 | 83.1 | 7.3 | 3.4 | 24.1 | 9.8 | 4.5 | β + θ |
| 4 | C | 1.4 | 80.8 | 13.4 | 2.7 | 15.3 | 7.8 | 0.7 | θ |
| 5 | C | 1.2 | 87.3 | 9.6 | 3.2 | 21.5 | 5.4 | 0.6 | θ |
| 6 | C | 1.4 | 80.9 | 9.8 | 3.7 | 22.8 | 8.6 | 0.6 | θ |
| 7 | C | 1.4 | 78.8 | 12.5 | 3.6 | 20.5 | 6.5 | 0.6 | θ |
| 8 | C | 2.0 | 86.5 | 9.4 | 3.6 | 20.8 | 5.8 | 0.7 | θ |
| 9 | C | 1.3 | 42.1 | 33.1 | 0.8 | 18.1 | 8.1 | 4.2 | TM + θ |
| 10 | C | 0.9 | 80.8 | 0.1 | 8.5 | 25.7 | 0.6 | 3.3 | TM + θ |
| 11 | C | 1.1 | 86.8 | 0.9 | 8.4 | 28.5 | 0.6 | 6.4 | TM + θ |
| 12 | C | 1.4 | 42.1 | 25.1 | 0.8 | 12.7 | 7.3 | 6.9 | TM + θ |
| 13 | C | 1.4 | 79.3 | 0.8 | 8.3 | 23.8 | 6.7 | 3.5 | TM + θ |
| 14 | C | 1.4 | 81.3 | 0.4 | 8.3 | 28.1 | 0.6 | 3.9 | P + θ |
| 15 | D | 1.4 | 79.2 | 7.5 | 4.1 | 17.9 | 6.2 | 5.7 | θ |
| 16 | E | 1.4 | 79.9 | 19.7 | 3.3 | 12.3 | 6.8 | 3.2 | θ |
| 17 | F | 1.2 | 88.2 | 6.4 | 7.3 | 26.7 | 2.6 | 3.7 | θ |
| 18 | G | 1.4 | 90.8 | 7.0 | 7.0 | 29.8 | 5.2 | 6.1 | P + θ |
| 19 | H | 2.0 | 75.9 | 19.9 | 2.4 | 4.0 | 10.3 | 2.1 | θ |
| 20 | I | 1.2 | 89.1 | 6.7 | 6.8 | 27.9 | 0.8 | 4.8 | θ |
| 21 | J | 1.4 | 85.4 | 10.9 | 4.1 | 21.1 | 9.6 | 3.6 | θ |
| 22 | K | 1.1 | 87.1 | 10.7 | 3.3 | 13.7 | 8.5 | 5.2 | θ |
| 23 | L | 1.8 | 85.3 | 10.4 | 2.9 | 16.4 | 6.8 | 4.8 | θ |
| 24 | M | 1.4 | 69.1 | 21.9 | 1.6 | 5.9 | 11.5 | 5.8 | TM + θ |
| 25 | N | 1.4 | 75.8 | 18.5 | 1.8 | 4.4 | 11.6 | 4.4 | B + θ |
| 26 | O | 1.5 | 80.7 | 7.5 | 3.3 | 10.4 | 7.3 | 2.5 | θ |
| 27 | P | 1.4 | 84.0 | 15.0 | 3.0 | 8.1 | 8.8 | 6.7 | θ |
| 28 | Q | 1.0 | 70.9 | 19.1 | 2.2 | 3.7 | 10.7 | 3.8 | TM + θ |
| 29 | R | 2.5 | 78.6 | 10.2 | 3.2 | 22.5 | 6.1 | 2.3 | θ |
| 30 | S | 1.0 | 79.2 | 13.9 | 3.6 | 13.7 | 7.2 | 6.0 | θ |
| 31 | T | 1.0 | 79.1 | 7.3 | 2.9 | 13.7 | 9.5 | 3.6 | θ |
| 32 | U | 0.8 | 78.0 | 10.5 | 3.9 | 20.6 | 9.0 | 4.0 | θ |

TABLE 3-continued

| | | | | | | | | | |
|---|---|---|---|---|---|---|---|---|---|
| 33 | V | 1.0 | 82.9 | 12.7 | 3.8 | 19.1 | 9.9 | 3.1 | θ |
| 34 | W | 1.2 | 81.8 | 12.6 | 3.4 | 20.1 | 9.7 | 3.6 | θ |
| 35 | X | 1.0 | 79.5 | 17.0 | 5.5 | 13.5 | 4.6 | 1.9 | θ |

| No. | YP (MPa) | TS (MPa) | YR (%) | EI (%) | TS × EI (MPa · %) | \|ΔYP\| (MPa) | Coatability | Remarks |
|---|---|---|---|---|---|---|---|---|
| 1 | 392 | 628 | 62 | 28.0 | 17584 | 27 | — | Example |
| 2 | 422 | 660 | 64 | 25.4 | 16764 | 42 | Fair | Example |
| 3 | 380 | 650 | 58 | 26.2 | 17030 | 32 | Fair | Example |
| 4 | 442 | 645 | 69 | 23.8 | 15382 | 58 | Fair | Comparative Example |
| 5 | 370 | 638 | 58 | 29.4 | 18757 | 67 | Fair | Comparative Example |
| 6 | 563 | 717 | 79 | 19.3 | 13838 | 42 | Fair | Comparative Example |
| 7 | 409 | 684 | 60 | 21.0 | 14364 | 62 | — | Comparative Example |
| 8 | 354 | 604 | 59 | 32.1 | 19388 | 55 | Fair | Comparative Example |
| 9 | 408 | 537 | 76 | 31.5 | 16916 | 47 | Fair | Comparative Example |
| 10 | 428 | 533 | 80 | 29.4 | 15670 | 31 | Fair | Comparative Example |
| 11 | 338 | 535 | 63 | 29.6 | 15836 | 34 | Poor | Comparative Example |
| 12 | 404 | 532 | 76 | 30.4 | 16173 | 17 | — | Comparative Example |
| 13 | 442 | 539 | 82 | 29.8 | 16062 | 29 | — | Comparative Example |
| 14 | 514 | 672 | 76 | 25.8 | 17338 | 46 | Fair | Comparative Example |
| 15 | 406 | 642 | 63 | 27.3 | 17527 | 49 | Excellent | Example |
| 16 | 439 | 711 | 62 | 24.3 | 17277 | 12 | Excellent | Example |
| 17 | 351 | 532 | 66 | 29.9 | 15907 | 14 | Excellent | Comparative Example |
| 18 | 420 | 522 | 80 | 31.8 | 16600 | 36 | — | Comparative Example |
| 19 | 658 | 819 | 80 | 17.2 | 14087 | 80 | Poor | Comparative Example |
| 20 | 452 | 602 | 75 | 29.9 | 18000 | 28 | Excellent | Example |
| 21 | 370 | 620 | 60 | 28.6 | 17732 | 27 | — | Example |
| 22 | 373 | 635 | 59 | 28.0 | 17780 | 14 | Excellent | Example |
| 23 | 448 | 742 | 60 | 21.8 | 16176 | 19 | Excellent | Example |
| 24 | 551 | 825 | 67 | 19.2 | 15840 | 11 | Excellent | Example |
| 25 | 556 | 828 | 67 | 18.6 | 15401 | 39 | — | Example |
| 26 | 387 | 631 | 61 | 28.1 | 17731 | 35 | Excellent | Example |
| 27 | 418 | 706 | 59 | 24.4 | 17226 | 45 | Excellent | Example |
| 28 | 513 | 789 | 65 | 19.2 | 15149 | 40 | — | Example |
| 29 | 457 | 737 | 62 | 23.5 | 17320 | 12 | Excellent | Example |
| 30 | 394 | 646 | 61 | 27.3 | 17636 | 32 | — | Example |
| 31 | 379 | 623 | 61 | 28.4 | 17693 | 38 | Excellent | Example |
| 32 | 457 | 710 | 64 | 23.9 | 16969 | 14 | Excellent | Example |
| 33 | 382 | 625 | 61 | 28.1 | 17563 | 21 | Excellent | Example |
| 34 | 386 | 623 | 62 | 28.1 | 17506 | 18 | Excellent | Example |
| 35 | 436 | 611 | 71 | 31.8 | 19430 | 22 | Excellent | Example |

F: ferrite,
M: martensite,
B: bainite,
TM: tempered martensite,
P: pearlite,
θ: cementite (including alloy carbides)

INDUSTRIAL APPLICABILITY

According to embodiments of the present invention, production of a high-strength steel sheet having a TS of 540 MPa or more, excellent ductility, a low YR, and excellent YP planar anisotropy, is enabled. Moreover, when the high-strength steel sheet obtained according to the production method of the present invention is applied to, for example, automobile structural elements, fuel efficiency can be improved through car body weight reduction, and thus the present invention offers considerable industrial advantages.

The invention claimed is:

1. A steel sheet comprising:

a composition that contains, in terms of mass %,
C: 0.03% or more and 0.20% or less,
Si: 0.70% or less,
Mn: 1.50% or more and 3.00% or less,
P: 0.001% or more and 0.100% or less,
S: 0.0001% or more and 0.0200% or less,
Al: 0.001% or more and 1.000% or less,
N: 0.0005% or more and 0.0100% or less, and
the balance being Fe and unavoidable impurities;

a steel structure containing ferrite and a secondary phase, in which an area fraction of the ferrite is 50% or more, the secondary phase contains 1.0% or more and 25.0% or less of martensite in terms of area fraction with respect to the entirety of the steel structure, the ferrite has an average crystal grain size of 3 μm or more, a difference in hardness between the martensite ferrite and the ferrite martensite is 1.0 GPa or more and 8.0 GPa or less, and, in a texture of the ferrite, an inverse intensity ratio of γ-fiber to α-fiber is 0.8 or more and 7.0 or less; and, a tensile strength of 540 MPa or more and a yield ratio of 67% or less, wherein the steel sheet has a planar anisotropy of YP, |ΔYP|, of 50 MPa or less, |ΔYP| being determined by formula (1) below:

$$|\Delta YP| = (YPL - 2 \times YPD + YPC)/2 \quad (1)$$

where YPL, YPD, and YPC respectively represent values of YP measured from JIS No. 5 test pieces taken in three directions, namely, the rolling direction (L direction) of the steel sheet, a direction (D direction) 45° with respect to the rolling direction of the steel sheet, and a direction (C direction) 90° with respect to the rolling direction of the steel sheet, by a tensile test in accordance with the description of JIS Z 2241 (2011) at a crosshead speed of 10 mm/min.

2. The steel sheet according to claim 1, wherein the martensite has an average size of 1.0 μm or more and 15.0 μm or less.

3. The steel sheet according to claim 1, wherein the composition further contains, in terms of mass %, at least one element selected from Mo: 0.01% or more and 0.50% or less,
Ti: 0.001% or more and 0.100% or less,
Nb: 0.001% or more and 0.100% or less,
V: 0.001% or more and 0.100% or less,
B: 0.0001% or more and 0.0050% or less,
Cr: 0.01% or more and 1.00% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

4. The steel sheet according to claim 2, wherein the composition further contains, in terms of mass %, at least one element selected from Mo: 0.01% or more and 0.50% or less,
Ti: 0.001% or more and 0.100% or less,
Nb: 0.001% or more and 0.100% or less,
V: 0.001% or more and 0.100% or less,
B: 0.0001% or more and 0.0050% or less,
Cr: 0.01% or more and 1.00% or less,
Cu: 0.01% or more and 1.00% or less,
Ni: 0.01% or more and 1.00% or less,
As: 0.001% or more and 0.500% or less,
Sb: 0.001% or more and 0.200% or less,
Sn: 0.001% or more and 0.200% or less,
Ta: 0.001% or more and 0.100% or less,
Ca: 0.0001% or more and 0.0200% or less,
Mg: 0.0001% or more and 0.0200% or less,
Zn: 0.001% or more and 0.020% or less,
Co: 0.001% or more and 0.020% or less,
Zr: 0.001% or more and 0.020% or less, and
REM: 0.0001% or more and 0.0200% or less.

5. A coated steel sheet comprising the steel sheet described in claim 1, and a coating layer on a surface of the steel sheet.

6. A coated steel sheet comprising the steel sheet described in claim 2, and a coating layer on a surface of the steel sheet.

7. A coated steel sheet comprising the steel sheet described in claim 3, and a coating layer on a surface of the steel sheet.

8. A coated steel sheet comprising the steel sheet described in claim 4, and a coating layer on a surface of the steel sheet.

9. A method for producing a hot-rolled steel sheet for producing the steel sheet according to claim 1, the method comprising heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower.

10. A method for producing a hot-rolled steel sheet for producing the steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower.

11. A method for producing a cold-rolled full hard steel sheet for producing the steel sheet according to claim 1, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower; and pickling the hot-rolled steel sheet, and cold-rolling the pickled steel sheet at a rolling reduction of 35% or more.

12. A method for producing a cold-rolled full hard steel sheet for producing the steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower; and pickling the hot-rolled steel sheet, and cold-rolling the pickled steel sheet at a rolling reduction of 35% or more.

13. A method for producing a steel sheet according to claim 1, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower; and heating the hot-rolled steel sheet under conditions of a maximum attained temperature of a T1 temperature or higher and a T2 temperature or lower and a residence time of 500 s or less in a temperature range of [maximum attained temperature—50° C.] to the maximum attained temperature; and cooling the heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1\ \text{temperature}\ (^\circ\ \text{C.})=745+29\times[\%\ \text{Si}]-21\times[\%\ \text{Mn}]+17\times[\%\ \text{Cr}]$$

$$T2\ \text{temperature}\ (^\circ\ \text{C.})=960-203\times[\%\ \text{C}]^{1/2}+45\times[\%\ \text{Si}]-30\times[\%\ \text{Mn}]+150\times[\%\ \text{Al}]-20\times[\%\ \text{Cu}]+11\times[\%\ \text{Cr}]+350\times[\%\ \text{Ti}]+104\times[\%\ \text{V}]$$

where in the formulae above, [% X] denotes a content (mass %) of a component element X in the steel sheet.

14. A method for producing a steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower; and heating the hot-rolled steel sheet under conditions of a maximum attained temperature of a T1 temperature or higher and a T2 temperature or lower and a residence time of 500 s or less in a temperature range of [maximum attained temperature—50° C.] to the maximum attained temperature; and cooling the heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1\ \text{temperature}\ (^\circ\ \text{C.})=745+29\times[\%\ \text{Si}]-21\times[\%\ \text{Mn}]+17\times[\%\ \text{Cr}]$$

$$T2\ \text{temperature}\ (^\circ\ \text{C.})=960-203\times[\%\ \text{C}]^{1/2}+45\times[\%\ \text{Si}]-30\times[\%\ \text{Mn}]+150\times[\%\ \text{Al}]-20\times[\%\ \text{Cu}]+11\times[\%\ \text{Cr}]+350\times[\%\ \text{Ti}]+104\times[\%\ \text{V}]$$

where in the formulae above, [% X] denotes a content (mass %) of a component element X in the steel sheet.

15. A method for producing a steel sheet according to claim 1, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

pickling the hot-rolled steel sheet, and cold-rolling the pickled steel sheet at a rolling reduction of 35% or more;

heating the cold-rolled full hard steel sheet under conditions of a maximum attained temperature of a T1 temperature or higher and a T2 temperature or lower and a residence time of 500 s or less in a temperature range of [maximum attained temperature—50° C.] to the maximum attained temperature; and cooling the heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1\ \text{temperature}\ (^\circ\ \text{C.})=745+29\times[\%\ \text{Si}]-21\times[\%\ \text{Mn}]+17\times[\%\ \text{Cr}]$$

$$T2\ \text{temperature}\ (^\circ\ \text{C.})=960-203\times[\%\ \text{C}]^{1/2}+45\times[\%\ \text{Si}]-30\times[\%\ \text{Mn}]+150\times[\%\ \text{Al}]-20\times[\%\ \text{Cu}]+11\times[\%\ \text{Cr}]+350\times[\%\ \text{Ti}]+104\times[\%\ \text{V}]$$

where in the formulae above, [% X] denotes a content (mass %) of a component element X in the steel sheet.

16. A method for producing a steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

pickling the hot-rolled steel sheet, and cold-rolling the pickled steel sheet at a rolling reduction of 35% or more;

heating the cold-rolled full hard steel sheet under conditions of a maximum attained temperature of a T1 temperature or higher and a T2 temperature or lower and a residence time of 500 s or less in a temperature range of [maximum attained temperature—50° C.] to the maximum attained temperature; and cooling the heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

17. A method for producing a heat-treated sheet for producing the steel sheet according to claim 1, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

heating the hot-rolled steel sheet under conditions of a maximum attained temperature of a T1 temperature or higher and a T2 temperature or lower and a residence time of 500 s or less in a temperature range of [maximum attained temperature—50° C.] to the maximum attained temperature; and then cooling the heated sheet and pickling the cooled sheet, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

18. A method for producing a heat-treated sheet for producing the steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower; and heating the hot-rolled steel sheet under conditions of a maximum attained temperature of a T1 temperature or higher and a T2 temperature or lower and a residence time of 500 s or less in a temperature range of [maximum attained temperature—50° C.] to the maximum attained temperature; and then cooling the heated sheet and pickling the cooled sheet, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

19. A method for producing a heat-treated sheet for producing the steel sheet according to claim 1, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

pickling the hot-rolled steel sheet, and cold-rolling the pickled steel sheet at a rolling reduction of 35% or more; and heating the cold-rolled full hard steel sheet under conditions of a maximum attained temperature of a T1 temperature or higher and a T2 temperature or lower and a residence time of 500 s or less in a temperature range of [maximum attained temperature—50° C.] to the maximum attained temperature; and then cooling the heated sheet and pickling the cooled sheet, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

20. A method for producing a heat-treated sheet for producing the steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

pickling the hot-rolled steel sheet, and cold-rolling the pickled steel sheet at a rolling reduction of 35% or more; and heating the cold-rolled full hard steel sheet under conditions of a maximum attained temperature of a T1 temperature or higher and a T2 temperature or lower and a residence time of 500 s or less in a temperature range of [maximum attained temperature—50° C.] to the maximum attained temperature; and then cooling the heated sheet and pickling the cooled sheet, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

21. A method for producing a steel sheet according to claim 1, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

heating the hot-rolled steel sheet under conditions of a maximum attained temperature of a T1 temperature or higher and a T2 temperature or lower and a residence time of 500 s or less in a temperature range of [maximum attained temperature—50° C.] to the maximum attained temperature; then cooling the heated sheet and pickling the cooled sheet; and re-heating the heat-treated sheet to a temperature equal to or higher than the T1 temperature; and then cooling the re-heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

22. A method for producing a steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

heating the hot-rolled steel sheet under conditions of a maximum attained temperature of a T1 temperature or higher and a T2 temperature or lower and a residence time of 500 s or less in a temperature range of [maximum attained temperature—50° C.] to the maximum attained temperature; then cooling the heated sheet and pickling the cooled sheet; and re-heating the heat-treated sheet to a temperature equal to or higher than the T1 temperature; and then cooling the re-heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

23. A method for producing a steel sheet according to claim 1, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

pickling the hot-rolled steel sheet, and cold-rolling the pickled steel sheet at a rolling reduction of 35% or more;

heating the cold-rolled full hard steel sheet under conditions of a maximum attained temperature of a T1 temperature or higher and a T2 temperature or lower and a residence time of 500 s or less in a temperature range of [maximum attained temperature—50° C.] to the maximum attained temperature; then cooling the heated sheet and pickling the cooled sheet; and re-heating the heat-treated sheet to a temperature equal to or higher than the T1 temperature; and then cooling the re-heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1 \text{ temperature } (^\circ \text{ C.}) = 745 + 29 \times [\% \text{ Si}] - 21 \times [\% \text{ Mn}] + 17 \times [\% \text{ Cr}]$$

$$T2 \text{ temperature } (^\circ \text{ C.}) = 960 - 203 \times [\% \text{ C}]^{1/2} + 45 \times [\% \text{ Si}] - 30 \times [\% \text{ Mn}] + 150 \times [\% \text{ Al}] - 20 \times [\% \text{ Cu}] + 11 \times [\% \text{ Cr}] + 350 \times [\% \text{ Ti}] + 104 \times [\% \text{ V}]$$

where in the formulae above, [% X] denotes a content (mass %) of a component element X in the steel sheet.

24. A method for producing a steel sheet according to claim 3, the method comprising:

heating a steel slab having the composition; rough-rolling the heated steel slab; in subsequent finish-rolling, hot-rolling the rough-rolled steel slab under conditions of a finish-rolling inlet temperature of 1020° C. or higher and 1180° C. or lower, a rolling reduction in a final pass of the finish rolling of 5% or more and 15% or less, a rolling reduction in a pass before the final pass of 15% or more and 25% or less, and a finish-rolling delivery temperature of 800° C. or higher and 1000° C. or lower; cooling the hot-rolled steel sheet at an average cooling rate of 5° C./s or more and 90° C./s or less; and coiling the cooled steel sheet under a condition of a coiling temperature of 300° C. or higher and 700° C. or lower;

pickling the hot-rolled steel sheet, and cold-rolling the pickled steel sheet at a rolling reduction of 35% or more;

heating the cold-rolled full hard steel sheet under conditions of a maximum attained temperature of a T1 temperature or higher and a T2 temperature or lower and a residence time of 500 s or less in a temperature range of [maximum attained temperature—50° C.] to the maximum attained temperature; and then cooling the heated sheet and pickling the cooled sheet; and re-heating the heat-treated sheet to a temperature equal to or higher than the T1 temperature; and then cooling the re-heated sheet under a condition of an average cooling rate of 3° C./s or more in a temperature range of [T1 temperature—10° C.] to 550° C., wherein a dew point in a temperature range of 600° C. or higher is −40° C. or lower, where:

$$T1\ \text{temperature}\ (^\circ\ \text{C.})=745+29\times[\%\ \text{Si}]-21\times[\%\ \text{Mn}]+17\times[\%\ \text{Cr}]$$

$$T2\ \text{temperature}\ (^\circ\ \text{C.})=960-203\times[\%\ \text{C}]^{1/2}+45\times[\%\ \text{Si}]-30\times[\%\ \text{Mn}]+150\times[\%\ \text{Al}]-20\times[\%\ \text{Cu}]+11\times[\%\ \text{Cr}]+350\times[\%\ \text{Ti}]+104\times[\%\ \text{V}]$$

where in the formulae above, [% X] denotes a content (mass %) of a component element X in the steel sheet.

25. A method for producing a coated steel sheet, the method including coating a steel sheet obtained in the method according to claim 13.

26. A method for producing a coated steel sheet, the method including coating a steel sheet obtained in the method according to claim 14.

27. A method for producing a coated steel sheet, the method including coating a steel sheet obtained in the method according to claim 15.

28. A method for producing a coated steel sheet, the method including coating a steel sheet obtained in the method according to claim 16.

29. A method for producing a coated steel sheet, the method including coating a steel sheet obtained in the method according to claim 21.

30. A method for producing a coated steel sheet, the method including coating a steel sheet obtained in the method according to claim 22.

31. A method for producing a coated steel sheet, the method including coating a steel sheet obtained in the method according to claim 23.

32. A method for producing a coated steel sheet, the method including coating a steel sheet obtained in the method according to claim 24.

* * * * *